US011581631B2

(12) United States Patent
Li et al.

(10) Patent No.: US 11,581,631 B2
(45) Date of Patent: Feb. 14, 2023

(54) BASE STATION ANTENNAS HAVING RADOMES THAT REDUCE COUPLING BETWEEN COLUMNS OF RADIATING ELEMENTS OF A MULTI-COLUMN ARRAY

(71) Applicant: CommScope Technologies LLC, Hickory, NC (US)

(72) Inventors: Haifeng Li, Richardson, TX (US); XiaoHua Hou, Richardson, TX (US); Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/468,783

(22) Filed: Sep. 8, 2021

(65) Prior Publication Data

US 2022/0102842 A1 Mar. 31, 2022

Related U.S. Application Data

(60) Provisional application No. 63/083,379, filed on Sep. 25, 2020.

(51) Int. Cl.
*H01Q 1/24* (2006.01)
*H01Q 19/10* (2006.01)
(Continued)

(52) U.S. Cl.
CPC ..... *H01Q 1/246* (2013.01); *H01Q 1/42* (2013.01); *H01Q 19/10* (2013.01); *H01Q 21/061* (2013.01)

(58) Field of Classification Search
CPC ..... H01Q 1/246; H01Q 1/42; H01Q 1/422; H01Q 9/10; H01Q 21/06; H01Q 21/061; H01Q 21/28
See application file for complete search history.

(56) References Cited

U.S. PATENT DOCUMENTS

2005/0190116 A1 9/2005 Syed et al.
2014/0062826 A1* 3/2014 Jonsson ..... H01Q 19/10 343/893

(Continued)

FOREIGN PATENT DOCUMENTS

EP 3866261 A1 * 8/2021 ..... B32B 27/08
WO 2019236203 A2 12/2019
WO 2020072880 A1 4/2020

OTHER PUBLICATIONS

International Search Report and the Written Opinion of the International Searching Authority corresponding to International Patent Application No. PCT/US2021/049342 (16 pages) (dated Dec. 6, 2021).

*Primary Examiner* — Jason Crawford
(74) *Attorney, Agent, or Firm* — Myers Bigel, P.A.

(57) ABSTRACT

A base station antenna includes an internal radome and a multi-column antenna array antenna. The internal radome can be configured with a plurality of columns, each having an outwardly projecting peak segment and each neighboring column of the internal radome can be separated by a valley. Each outwardly projecting peak segment(s) is oriented to project toward a front of the base station antenna and is positioned medially aligned over a respective column of the multi-column antenna array to thereby reduce mutual coupling of respective elements and/or columns of elements and/or provide a common near field environment for each element and/or each column.

24 Claims, 18 Drawing Sheets
(6 of 18 Drawing Sheet(s) Filed in Color)

(51) Int. Cl.
*H01Q 21/06* (2006.01)
*H01Q 1/42* (2006.01)

(56) References Cited

U.S. PATENT DOCUMENTS

| | | | | |
|---|---|---|---|---|
| 2015/0130672 | A1* | 5/2015 | Cordone | H01Q 1/28 343/705 |
| 2017/0040679 | A1* | 2/2017 | Fröhler | H01Q 1/246 |
| 2017/0179577 | A1 | 6/2017 | Sanford | |
| 2017/0223868 | A1* | 8/2017 | Zheng | H01Q 1/002 |
| 2018/0337443 | A1* | 11/2018 | Bisiules | H01Q 1/246 |
| 2019/0190127 | A1 | 6/2019 | Bryce | |
| 2020/0076068 | A1 | 3/2020 | Sutar | |
| 2021/0175617 | A1* | 6/2021 | Chen | H01Q 1/422 |
| 2021/0305684 | A1* | 9/2021 | Hou | H01Q 21/065 |
| 2021/0305717 | A1* | 9/2021 | Hou | H01Q 21/061 |
| 2021/0305718 | A1* | 9/2021 | Li | H01Q 21/062 |
| 2022/0102842 | A1* | 3/2022 | Li | H01Q 21/061 |

* cited by examiner

REGULAR CURVE RADOME 119′

FLAT RADOME 119″

NEW SHAPE RADOME 119

NEW SHAPE RADOME

FLAT RADOME

REGULAR CURVE RADOME

PATTERN COMPARISON

BASE STATION ANTENNAS HAVING RADOMES THAT REDUCE COUPLING BETWEEN COLUMNS OF RADIATING ELEMENTS OF A MULTI-COLUMN ARRAY

RELATED APPLICATIONS

This application claims the benefit of and priority to U.S. Provisional Application Ser. No. 63/083,379, filed Sep. 25, 2020, the contents of which are hereby incorporated by reference as if recited in full herein.

BACKGROUND

The present invention generally relates to radio communications and, more particularly, to base station antennas for cellular communications systems.

Cellular communications systems are well known in the art. In a cellular communications system, a geographic area is divided into a series of regions or "cells" that are served by respective base stations. Each base station may include one or more base station antennas that are configured to provide two-way radio frequency ("RF") communications with subscribers that are within the cell served by the base station. In many cases, each base station is divided into "sectors." In one common configuration, a hexagonally-shaped cell is divided into three 120° sectors in the azimuth plane, and each sector is served by one or more base station antennas that have an azimuth Half Power Beamwidth (HPBW) of approximately 65°. Typically, the base station antennas are mounted on a tower or other raised structure, with the radiation patterns that are generated by the base station antennas directed outwardly. Base station antennas are often implemented as linear or planar phased arrays of radiating elements.

Conventionally, most cellular communications systems have operated in frequency bands that are at frequencies of less than 2.8 GHz. In order to accommodate the increasing volume of cellular communications, a variety of new frequency bands are being assigned for cellular communications service. Some of the new frequency bands that are being introduced for cellular communications service are within the 3-6 GHz frequency range. The use of these frequency bands, which may be nearly an order of magnitude higher in frequency than some of the existing cellular frequency bands, may result in new challenges in base station antenna design. Additionally, so-called massive multi-input-multi-output ("MIMO") arrays are now routinely being included in base station antennas. These massive MIMO arrays typically operate in the higher frequency bands (e.g., above 2.3 GHz) and may include arrays having, for example, four, eight or even sixteen columns of radiating elements. While these massive MIMO arrays can dramatically increase the capacity of a base station antenna, they also raise certain challenges.

FIG. 1 illustrates an example of prior art base station antennas 10. The base station antenna 10 is typically mounted with the longitudinal axis L of the antenna 10 extending along a vertical axis (e.g., the longitudinal axis L may be generally perpendicular to a plane defined by the horizon) when the antenna 10 is mounted for normal operation. The front surface of the antenna 10 is mounted opposite the tower or other mounting structure, pointing toward the coverage area for the antenna 10. The antenna 10 includes a radome 11 and a top end cap 20. The antenna 10 also includes a bottom end cap 30 which includes a plurality of connectors 40 mounted therein. As shown, the radome 11, top cap 20 and bottom cap 30 define an external housing **10*h* for the antenna 10. An antenna assembly is contained within the housing 10*h***.

SUMMARY

Pursuant to embodiments of the present invention, base station antennas are provided with an internal radome spaced apart, in a front to back direction, from an outer (external) radome.

Embodiments of the present invention provide base station antennas with a radome having a plurality of peak segments, separated by valley segment.

Each peak segment can be aligned in front of a respective center of a radiating element of a column of a multi-column massive MIMO antenna array.

The inner radome may be closely spaced apart from (one wavelength or less) from the outer radome and/or the radiating elements of a massive MIMO antenna array.

Embodiments of the invention provide an active antenna module with a radome that is configured to reside inside a base station antenna, closely spaced apart from and facing an outer radome (a passive antenna radome).

The radome of the active antenna module can have a plurality of shaped outer facing segments, each shaped segment aligned with one or more column of radiating elements of a massive MIMO antenna array.

Embodiments of the invention are directed to a base station antenna that includes: an outer radome defining a front of the base station antenna; an internal radome; and a multi-column antenna array positioned behind the internal radome.

The internal radome can be configured with a plurality of peak segments that are laterally spaced apart, and wherein the peak segments project outwardly toward the front of the base station antenna behind the outer radome.

A respective peak segment of the plurality of peak segments can reside in front of and longitudinally and/or laterally aligned with at least one radiating element of a corresponding column of radiating elements of the multi-column antenna array.

Each peak segment can be separated by a pair of valley segments, one valley segment on a right side and one valley segment on a left side of the peak segment.

Each peak segment can be provided as a longitudinally extending peak segment that is positioned over a respective column of the multi-column antenna array to thereby reduce coupling between columns of radiating elements and/or provide a common near field environment for each radiating element and/or each column of radiating elements.

The multi-column antenna array can include radiating elements held by respective stalks. Radiating arms of the radiating elements can be positioned at a first distance d1 from the outer radome and a second distance d2 from the internal radome. The outer radome can be positioned a third distance d3 from the internal radome and d2 can be less than d1 and d3.

The multi-column antenna array can have radiating elements with radiating arms. The radiating arms can be positioned at a ½ wavelength or less from the inner radome, where the wavelength refers to the wavelength corresponding to the center frequency of the operating frequency band of the multi-column array, and the radiating arms can be positioned at 1 wavelength or more from the outer radome.

The internal radome can be configured to direct reflected signal back to an originating radiating element and/or column of radiating elements of the multi-column array to thereby reduce scattering and improve antenna performance.

A respective peak segment of the plurality of peak segments can define a cavity that is positioned over a respective radiating element of the multi-column antenna array.

The cavity can have an arcuate shape with an arc thereof curving over the respective radiating element to provide a maximal front facing portion laterally centered over a center of the respective radiating element.

The respective peak segment can merge into right and left side valley segments that project inwardly toward ends of radiating arms of neighboring radiating elements.

The plurality of peak segments can be arranged to be in a range of 4 and 16 laterally spaced apart peak segments that extend longitudinally along a length of the internal radome.

The internal radome can have opposing right and left sides that extend inwardly and couple to a reflector.

The internal radome can be configured to generate a near-field environment that is substantially the same for each radiating element and/or columns of radiating elements of the multi-column array.

The internal radome can be configured to cooperate with radiating elements of the multi-column array to provide an isolation of at least 19 dB between radiating elements in adjacent columns.

Yet other aspects are directed toward a base station antenna that includes: a reflector; a multi-column antenna array that extends forwardly from the reflector; and a radome that is positioned in front of the multi-column array. The radome includes a plurality of laterally spaced-apart peak segments that project outwardly away from the multi-column array.

A respective peak segment of the plurality of peak segments can reside in front of and longitudinally and/or laterally aligned with at least one radiating element of a corresponding column of radiating elements of the multi-column antenna array.

Each peak segment can be separated by a pair of valley segments, one valley segment on a right side and one valley segment on a left side of the peak segment.

Each peak segment can be provided as a longitudinally extending peak segment that is positioned over a respective column of the multi-column antenna array to thereby reduce coupling between columns of radiating elements and/or provide a common near field environment for each radiating element and/or each column of radiating elements.

The multi-column antenna array can include radiating elements held by respective stalks. Radiating arms of the radiating elements can be positioned at a first distance d1 from the outer radome and a second distance d2 from the internal radome. The outer radome can be positioned a third distance d3 from the internal radome, and d2 can be less than d1 and d3.

The multi-column antenna array can have radiating elements with radiating arms. The radiating arms can be positioned at a ½ wavelength or less from the inner radome, where the wavelength refers to the wavelength corresponding to the center frequency of the operating frequency band of the multi-column array. The radiating arms can be positioned at 1 (one) wavelength or more from the outer radome.

The internal radome can be configured to direct reflected signal back to an originating radiating element and/or column of radiating elements of the multi-column array to thereby reduce scattering and improve antenna performance.

A respective peak segment of the plurality of peak segments can define a cavity that is positioned over a respective radiating element of the multi-column antenna array.

The plurality of peak segments can be arranged to be in a range of 4 and 16 laterally spaced apart peak segments that extend longitudinally along a length of the internal radome.

The internal radome can be configured to generate a near-field environment that is substantially the same for each radiating element and/or columns of radiating elements of the multi-column array.

The internal radome can be configured to cooperate with radiating elements of the multi-column array to provide an isolation of at least 19 dB between radiating elements in adjacent columns.

Still other aspects are directed to base station antennas that have: a reflector; a multi-column antenna array that extends forwardly from the reflector; and a radome that is positioned in front of the multi-column array. The radome includes a plurality of longitudinally extending segments that are aligned in front of respective columns of the multi-column array, where each longitudinally-extending segment has a transverse cross-section that includes sub-segments that are at different front-to back-distances from the reflector.

The sub-segments can have respective peak segment that resides in front of and longitudinally and laterally aligned with a respective column of the multi-column antenna array.

Each peak segment can be separated by a pair of valley segments, one valley segment on a right side and one valley segment on a left side of the peak segment.

The sub-segments each have a peak segment that is positioned over a respective column of the multi-column antenna array to thereby reduce coupling between columns of radiating elements and/or provide a common near field environment for each radiating element and/or each column of radiating elements.

The radome can be an internal radome. The base station antenna can further include an external radome that resides in front of the internal radome. The multi-column antenna array can have radiating elements held by respective stalks. Radiating arms of the radiating elements can be positioned at a first distance d1 from the outer radome and a second distance d2 from the internal radome. The outer radome can be positioned a third distance d3 from the internal radome, and d2 can be less than d1 and d3.

The radome can be an internal radome. The base station antenna can further include an external radome that resides in front of the internal radome. The multi-column antenna array can have radiating elements with radiating arms. The radiating arms can be positioned at a ½ wavelength or less from the inner radome, where the wavelength refers to the wavelength corresponding to the center frequency of the operating frequency band of the multi-column array, and the radiating arms can be positioned at 1 (one) wavelength or more from the outer radome.

The internal radome can be configured to direct reflected signal back to an originating radiating element and/or column of radiating elements of the multi-column array to thereby reduce scattering and improve antenna performance.

A respective peak segment can define a cavity that is positioned over a respective radiating element of a corresponding column of the multi-column antenna array. The plurality of peak segments can be arranged to be in a range of 4 and 16 laterally spaced apart peak segments that extend longitudinally along a length, typically an entire length, of the internal radome.

The internal radome can be configured to generate a near-field environment that is substantially the same for each radiating element and/or columns of radiating elements of the multi-column array, and the internal radome can be configured to cooperate with radiating elements of the multi-column array to provide an isolation of at least 19 dB between radiating elements in adjacent columns.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
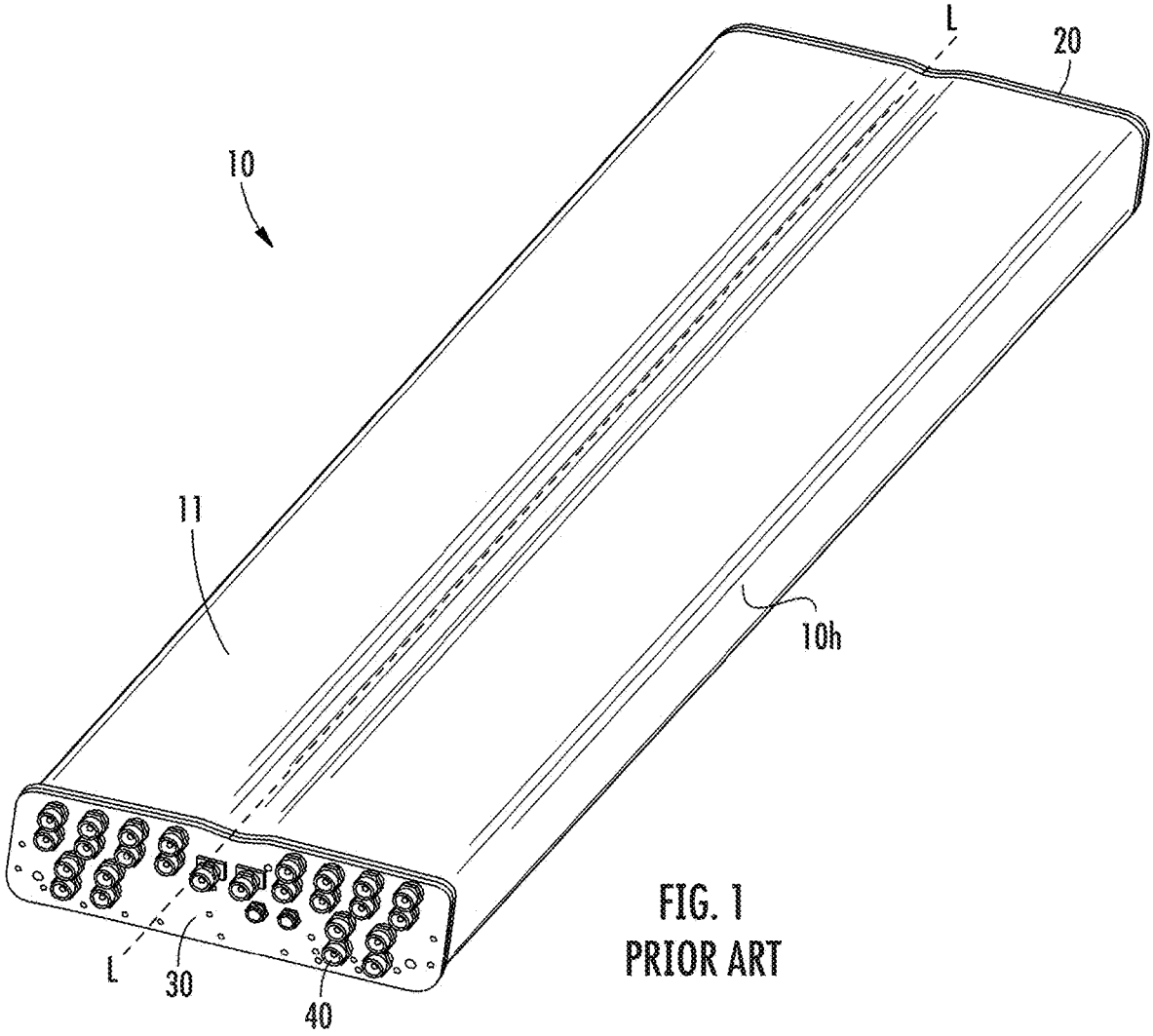
FIG. 1 PRIOR ART
FIG. 1 is a front, perspective view of an example prior art base station antenna.
Figure 2:
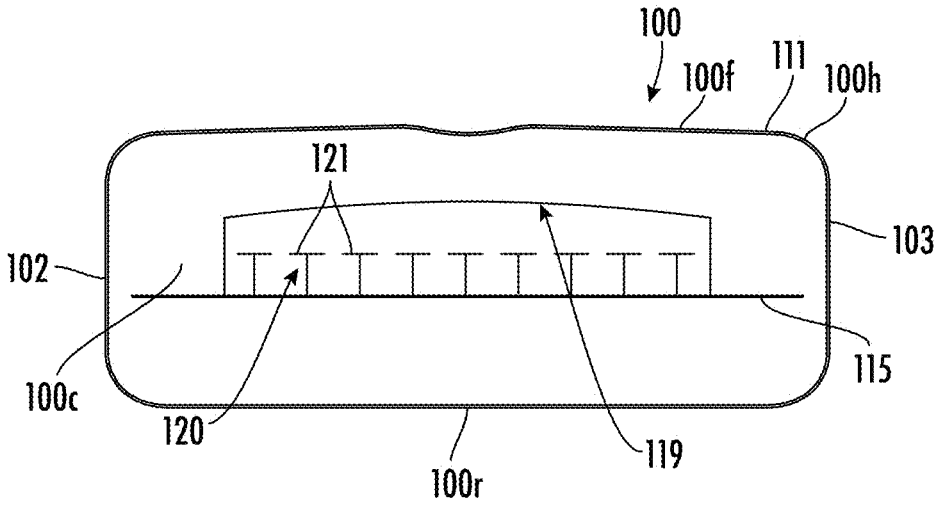
FIG. 2 is a simplified section view of a base station antenna according to embodiments of the present invention.

Referring to FIG. 2, the base station antenna 100 typically includes a radome 111 that serves as (defines) at least part of an outer housing 100*h* for the base station antenna 100. The radome 111 may protect the interior components of the antenna from damage during shipping and installation, and from rain, ice, snow, moisture, wind, insects, birds, and other environmental factors once the base station antenna 100 is installed for use. While base station antenna radomes may be formed of a variety of different materials, fiberglass radomes are the most common, as they are relatively lightweight, exhibit high mechanical strength and are reasonably inexpensive to manufacture.

Conventionally, the shape of a radome 111 for a base station antenna 100 is driven by wind loading concerns, as the radome forms most of the exterior of the base station antenna. As base station antennas 100 are often mounted hundreds of feet above the ground and have large surface areas, reducing wind loading may be very important in order to reduce the structural requirements for the mounting structure (e.g., an antenna tower).

With the introduction of fifth generation ("5G") cellular services, the base station antenna 100 can include a massive MIMO antenna array 120 (FIGS. 3, 5A-5C). "MIMO" refers to a communication technique in which a data stream is divided into individual sub-groups of data that are simultaneously transmitted, at the same frequency and using certain coding techniques, over multiple relatively uncorrelated transmission paths between a transmitting station and a receiving station. In a massive MIMO array 120, the radiating elements 121 (FIGS. 3, 5A-5C) are typically implemented as dual-polarized radiating elements. Since the two polarizations at which a dual polarized radiating element transmits and receives RF signals generally are uncorrelated from each other, each column of radiating elements in a massive MIMO array may form two of the relatively uncorrelated transmission paths.

Figure 3:
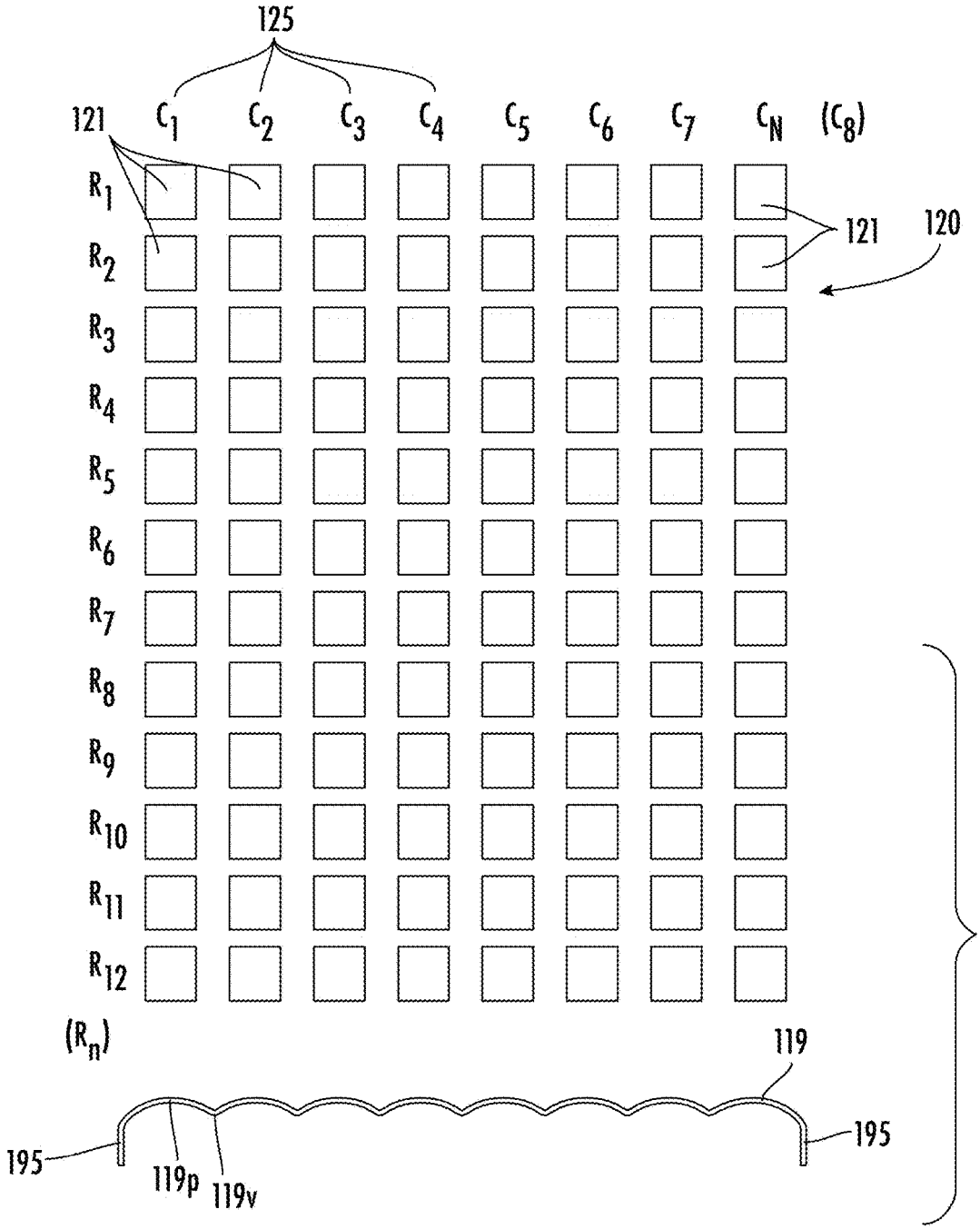
FIG. 3 is a simplified schematic illustration of a massive MIMO antenna array with an internal radome according to embodiments of the present invention.

Referring to FIG. 3, the columns 125 of radiating elements 121, labeled as columns $C_1$-Cn, ($C_1$-$C_8$ in the example embodiment shown) are spaced sufficiently far apart (e.g., at least a wavelength apart) so that the columns 125 will also be sufficiently uncorrelated from each other. Thus, a massive MIMO array having X columns and Y rows, labeled as rows $R_1$-Rn ($R_1$-$R_{12}$ in the example embodiment shown), of dual-polarized radiating elements 121 will typically be operated as a (2*X) MIMO antenna. The columns 125 can have any suitable number of radiating elements 121 such as 6, 8, 12 and 20, for example. Further details of example radiating elements 121 can be found in co-pending WO2019/236203 and WO2020/072880, the contents of which are hereby incorporated by reference as if recited in full herein.

Base station antennas 100 are also being introduced in which the massive MIMO antenna is an active antenna. An "active antenna" refers to an antenna in which the amplitude and/or phase of the RF signals transmitted and received by each radiating element (or small groups of radiating elements) may be manipulated in order to actively steer the pointing direction and shape of the antenna beams generated by the antenna. In some cases, the massive MIMO active antenna may be provided as an active antenna module 110 (FIGS. 16, 17A, 17B) that may be mounted on, typically coupled to a rear of the antenna 100 or in a conventional passive base station antenna housing 100*h*. The module 110 can include both the active radio circuitry as well as the radiating elements 121 that form all or part of the massive MIMO array 120.

As discussed above, each column 125 of a massive MIMO array 120 typically forms two of the multiple transmission paths. As also discussed above, the separate transmission paths used with MIMO communications need to be relatively uncorrelated with respect to each other (e.g., by using polarization diversity and/or physical separation). Of course, the more coupling that occurs between the columns of a massive MIMO antenna, the less the columns will be uncorrelated. Thus, reducing coupling between the columns 125 of a massive MIMO array 120 may be an important performance consideration for a massive MIMO antenna.

Unfortunately, the radome 111 of a base station antenna 100 can negatively impact the RF signals transmitted by the radiating elements of the base station antenna. For example, a radome 111 may reflect some of the RF energy transmitted by the linear arrays (columns) of radiating elements 121 of a base station antenna. Such reflections may undesirably increase coupling between the columns 125 of a massive MIMO array. Moreover, since the impact of the radome 111 is a function of the thickness of the radome 111 along the direction of travel of the RF energy, the radome 111 tends to have a greater impact on RF energy emitted at larger angles from the boresight pointing direction of the linear arrays, as at such angles the RF energy travels through more radome material. Consequently, the radome 111 may tend to have a greater impact in cases where the array active beam-steering is used to electronically scan the pointing direction of the antenna beam from the boresight pointing direction of the antenna. Additionally, the degree to which a radome will reflect RF signals tends to increase as the ratio of the thickness of the radome to the wavelength of the RF signal increases. Accordingly, the impact of a radome on the RF signals tends to increase as the thickness of the radome is increased and/or as the wavelength of the RF signal is reduced. As higher frequency RF signals have shorter wavelengths, massive MIMO arrays tend to be more negatively impacted by the radome of the base station antenna as these arrays tend to operate in higher frequency bands.

Pursuant to embodiments of the present invention, base station antennas 100 are provided that have a radome 119 (FIGS. 2, 3, 16, for example) that reduces coupling between adjacent columns. The radome 119 may be provided as an internal radome that resides between the outer radome 111 and the radiating elements 121. The radome 119 covers (resides in front of) at least some of the radiating elements 121 of the massive MIMO array 120 in order to improve performance of the base station antenna 100. For example, the radome 119 can be configured to reduce near-field coupling between radiating elements 121 of adjacent columns 125 and/or to improve reflection such as to reduce scattering of the transmitted RF signals. In such cases, the internal radome 119 will be located inside the base station antenna housing 100*h* (passive base station antenna housing) under the outer radome 111 and hence wind loading will not represent a performance issue with respect to this internal radome 119.

It is also contemplated that the radome 119 can be configured as the outer radome with an outer surface configured to accommodate the wind loading requirements and so as to not require a separate external radome. See, e.g., FIG. 10A. For ease of discussion, the radome 119 will be primarily referred to herein as the "internal" radome.

With columns spaced one wavelength (λ) apart, at higher frequencies such as 5 GHz, the spacing between columns 125 is much more narrow than at lower frequencies, e.g., 1.0 GHz and, without the internal radome 119, coupling between columns 125 can be stronger at 5 GHz.

The internal radome 119 can be configured to reduce mutual coupling of respective radiating elements 121 and/or columns 125 of radiating elements 121 and/or provide a common near field environment for each radiating element 121 and/or each column 125 of radiating elements 121.

The internal radome 119 and the outer/external radome 111 can both reside in a near-field environment.

The internal radome 119 can be configured to provide substantially the same near-field environment for at least a plurality of, and typically each, column 125 of the massive MIMO array 120.

The internal radome 119 can be configured to provide substantially the same near-field environment across all columns 125 when at a spacing of about one (1) wavelength X between columns 125 (measured center to center) at a frequency band of about 1.8 GHz, 2.5 GHz and/or 5 GHz.

The term "substantially the same" with respect to the near-field environment refers to +/−10% variation across the columns 125 under the internal radome 119. The near-field coupling can be similar at different operating frequency bands whereas the far field coupling/operation can be different.

The internal radome 119 can be configured to reflect all or most of a transmitted RF signal back to the originating column 125 of radiating elements 121.

The internal radome 119 can be configured to reduce scattering and RF coupling to neighboring columns 125 of radiating elements 121 relative to the same base station antenna 100 without the internal radome 119.

Embodiments of the present invention will now be discussed in greater detail with reference to the attached figures.

FIG. 2 illustrates a base station antenna 100 according to certain embodiments of the present invention. In particular, FIG. 2 is a simplified section view of the base station antenna 100. In the description that follows, the antenna 100 will be described using terms that assume that the antenna 100 is mounted for normal use on a tower or other structure with the longitudinal axis of the antenna 100 extending along a vertical axis (i.e., generally perpendicular to a plane defined by the horizon) and the front surface 100*f* of the antenna 100 mounted opposite the tower pointing toward the coverage area for the antenna 100. The base station antenna 100 has a housing 100*h* with a front surface 100*f* and an opposing rear surface 100*r* with sides 102, 103 coupled between the front and rear surfaces defining an interior cavity 100*c*. An external radome 111 defines and/or provides at least the front surface 100*f* of the housing 100*h*. The massive MIMO antenna array 120 resides inside the housing 100*h* facing an internal radome 119 that resides between the radiating elements 121 and the external radome 111. A reflector 115 can be positioned in the cavity 100*c* of the housing 100*h* behind the massive MIMO antenna array 120.

Figures 17A, 17B:
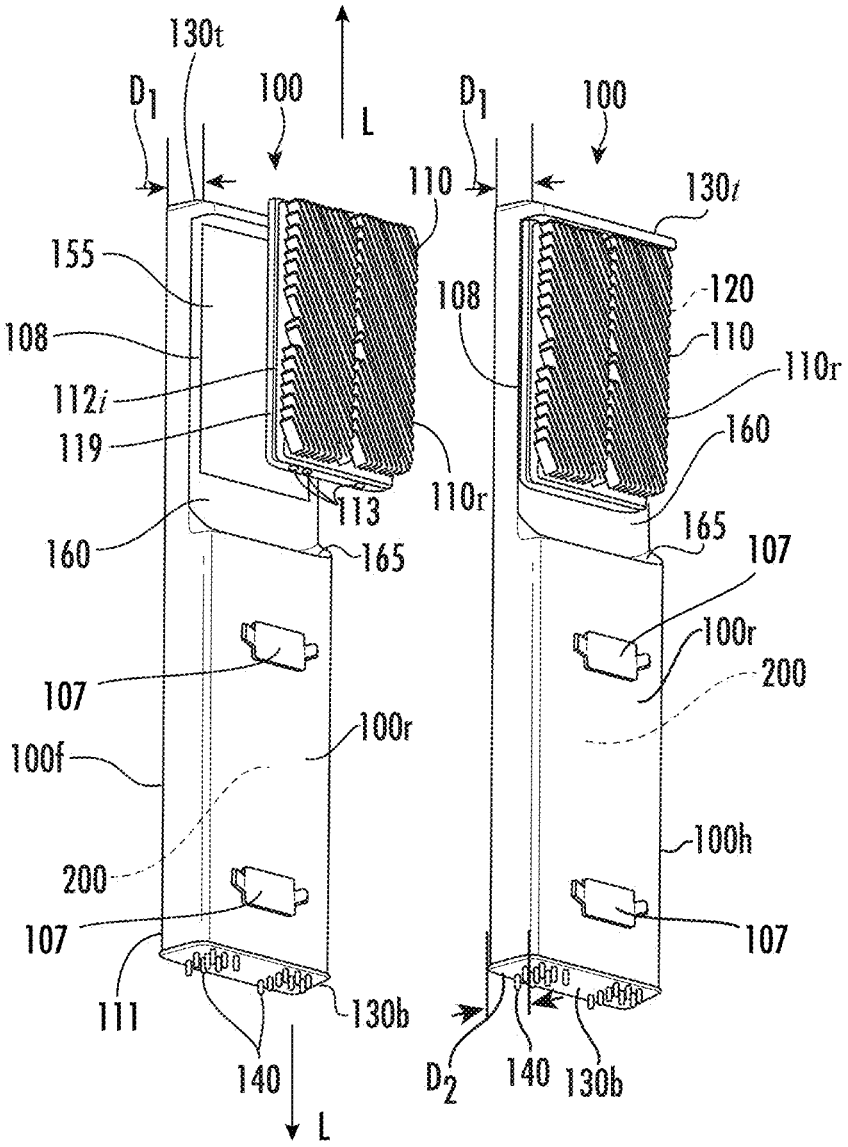
FIGS. 17A and 17B are back perspective views of example antenna base stations comprising a shaped internal radome according to embodiments of the present invention.

Referring to FIG. 2, FIGS. 17A and 17B, the base station antenna 100 is an elongated structure that extends along a longitudinal axis L. The base station antenna 100 may have a tubular shape with a generally rectangular cross-section. The antenna 100 includes the outer radome 111 at the front 100*f* of the housing 100*h*, a bottom end cap 130*b* and a top end cap 130*t*. In some embodiments, the radome 111 and the top end cap 130*t* may comprise a single integral unit, which may be helpful for waterproofing the antenna 100. Other configurations may be used that do not require a top end cap and seal the housing from the top in other ways. The external radome 111 may serve as a segment of the housing 100*h* that protects internal components of the antenna 100 from precipitation, moisture ingress, wind and the like. Preferably, the radome 111 is relatively rigid and mechanically strong to protect the internal components of the antenna during shipping and installation. One or more mounting brackets 107 can be provided, typically on the rear side 100*r* of the antenna 100, which may be used to mount the antenna 100 onto an antenna mount (not shown) on, for example, an antenna tower. The bottom end cap 130*b* includes a plurality of connectors 140 mounted therein.

The antenna 100 includes an antenna assembly 200 that includes the massive MIMO antenna array 120. At least part of the antenna assembly 200 may be slidably inserted into the housing 100*h* from either the top or bottom before the top cap 130*t* or bottom cap 130*b* are attached to the radome 111.

Referring to FIG. 3, the internal radome 119 can be provided with a patterned outer surface comprising contoured segments with a maximally outwardly projecting segment 119*p*, that can be referred to as a "peak", that resides between a pair of laterally spaced apart segments 119*v* that reside inward a distance relative to the peak 119*p*, in one or more planes behind and on each side of the peak 119*p*, that can be respectively referred to as a "valley". The internal radome 119 can also have laterally spaced apart outer sides 195 that extend inwardly further than the valleys 119*v* and that may couple directly or indirectly to the reflector 115 (FIG. 2).

In the embodiment shown in FIG. 3, the internal radome 119 comprises a plurality of peaks 119*p*, each configured to reside over a column 125 of the massive MIMO antenna array 120. Each peak 119*p* can be laterally aligned with and positioned medially over a radiating element 121 of a column 125 of the massive MIMO antenna array 120.

Figure 4:
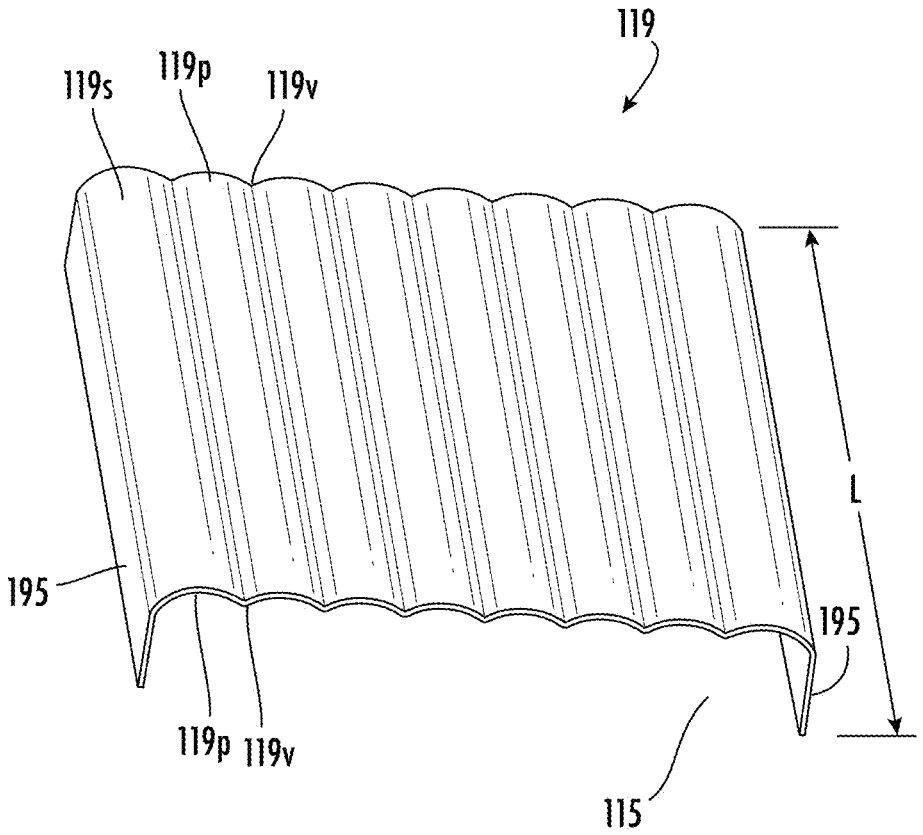
FIG. 4 is a front perspective view of an example radome according to embodiments of the present invention.

As shown in FIG. 4, the peak 119*p* can be a continuous outwardly projecting and longitudinally extending segment 119*s* forming a longitudinally extending peak segment 119*p* that extends over a column 125 of the internal radome 119, typically over an entire length L of the internal radome 119 or at least 50% of the length thereof.

The number of longitudinally extending segments 119*s* can equal the number of columns 125 of the radiating elements 121 of the massive MIMO array 120 (FIG. 2).

Figure 5A:
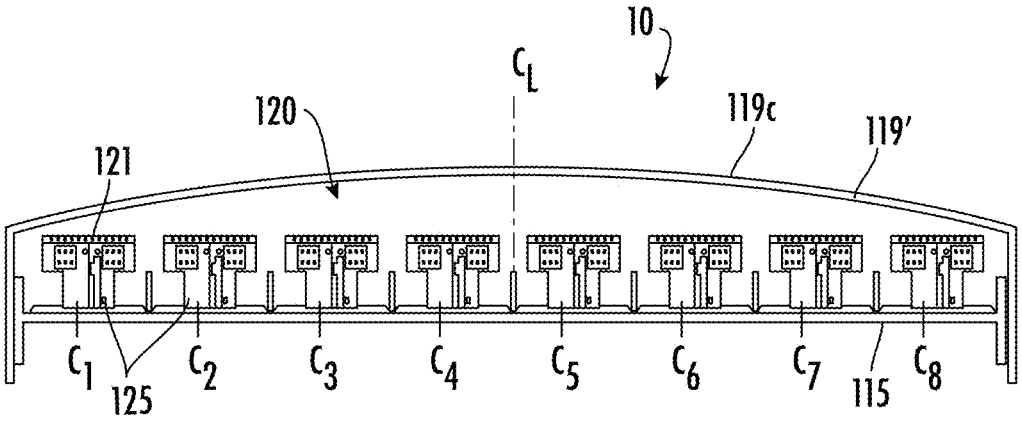
FIG. 5A is a section view of a massive MIMO antenna array configured to reside under a curved internal radome.

FIG. 5A illustrates that the internal radome 119' can have a curved shape that is arcuate over a laterally extending width W of the internal radome 119' and over the columns 125 (labeled as $C_1$-$C_8$) of the radiating elements 121 of the massive MIMO antenna array 120.

Figure 5B:
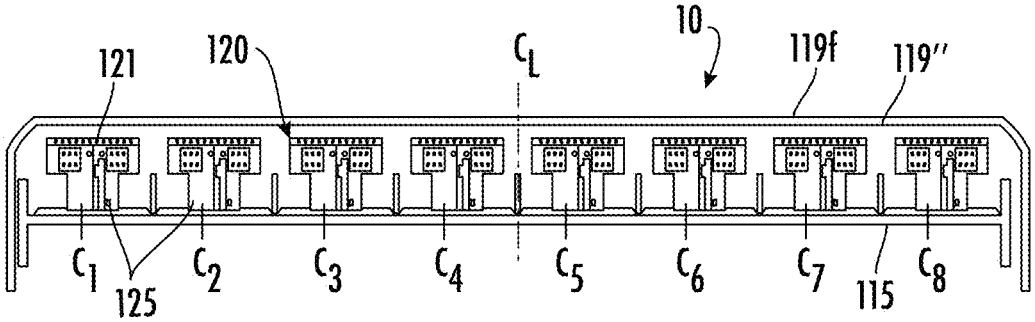
FIG. 5B is a section view of a massive MIMO antenna array under a flat internal radome according to embodiments of the present invention.

FIG. 5B illustrates that the internal radome 119" can be flat across the width W thereof and over the columns 125 (labeled as $C_1$-$C_8$) of the radiating elements 121 of the massive MIMO antenna array 120.

Figure 5C:
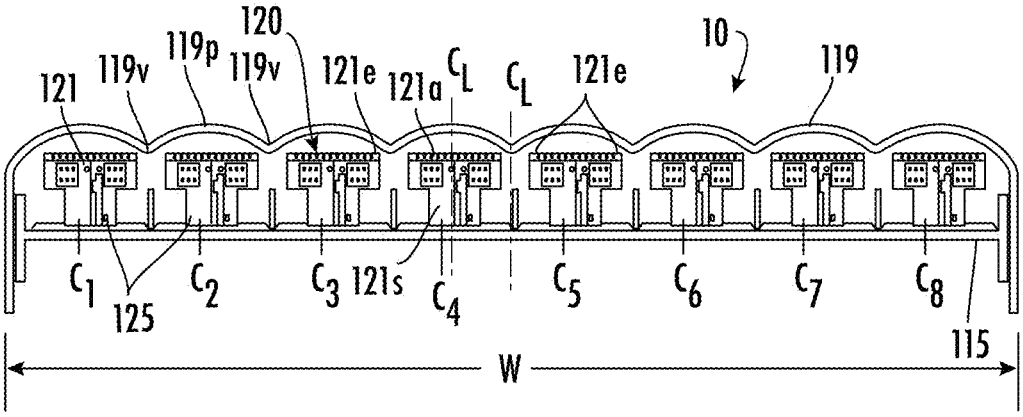
FIG. 5C is a section view of a massive MIMO antenna array under a shaped internal radome configured to reduce coupling between one or more adjacent rows and/or columns of radiating (antenna) elements of the massive MIMO antenna array according to embodiments of the present invention.

FIG. 5C illustrates the embodiment shown in FIG. 4 with the radome 119 provided as a patterned outer surface comprising peaks 119*p* and valleys 119*v* arranged with one peak 119*p* and a pair of valleys 119*v* corresponding to one column 125 of the columns (labeled as $C_1$-$C_8$) of the radiating elements 121 of the massive MIMO array 120.

As shown by the line marking the centerline through a radiating element in column 4 ($C_4$) in FIG. 5C, a respective (outermost projection of) peak 119*p* can reside aligned with and in front of a centerline of the radiating element 121. The valleys 119*v* can reside adjacent outer ends 121*e* of the arm 121*a*. The valleys 119*v* can reside laterally spaced apart a short distance from a neighboring end 121*e*, typically within a short distance. In some embodiments, this short distance is about 0.1 mm or greater. This short distance can vary based on the separation distance between columns 125. A respective valley 119*v* can be configured to reside midway between neighboring columns 125 of the radiating elements. The short distance spacing can depend on the column spacing. Thus, the short distance spacing can be between 0. 1 mm and 50% of the column spacing, in some embodiments. For example, the lower band has a much larger element spacing than higher band columns. For example, if the band is at about 1.9 GHz, the column spacing is typically about 75 mm. Then the short distance between the neighboring ends 121*e* may be over 10 mm, but can be within 50% of the column spacing. For embodiments comprising a mMIMO antenna, the short distance spacing can be in a range of 0.1 mm and within 25% of the column spacing. However, for a 4×4 MIMO antenna, the column spacing is typically much larger comparing the mMIMO antenna column spacing and the short distance spacing is greater than about 0.1 mm and less than 50% of the column spacing.

The valleys 119*v* can extend down toward the ends 121*e* of the radiating elements 121 and terminate at a position that is in front of, flush with or behind the ends 121*e* of the radiation elements 121 in a normal operational position (or above, flush with or beneath the ends 121*e* of the radiating elements 121 in the orientation of the radiating elements 121 and internal radome 119 shown in FIG. 5C).

An inwardly extending centerline (C/L) intersecting the radome 119 (in a front to back direction) can reside between two laterally adjacent innermost columns 125 of radiating elements 121 and can be aligned with a valley 119*v* of the internal radome 119 as shown in FIG. 5C, in some embodiments.

Figure 6A:
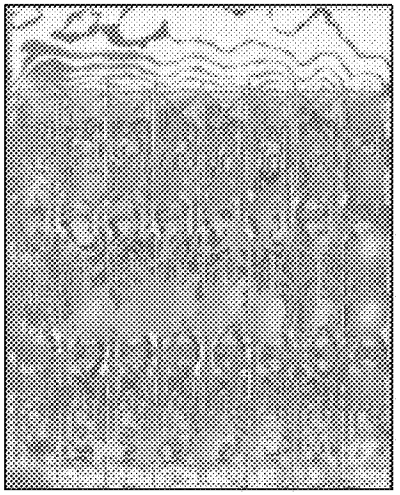
FIGS. 6A-6C are magnetic field graphs of respective massive MIMO antenna arrays and radomes corresponding to the massive MIMO antenna arrays and internal radomes shown in corresponding FIGS. 5A-5C, as generated by a computational model.
Figure 6B:
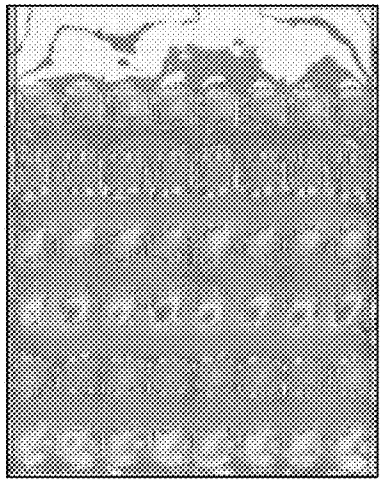
Figure 6C:
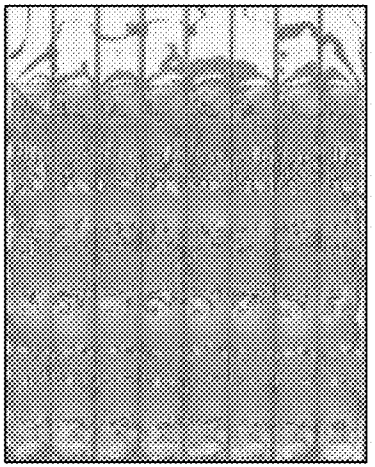

FIGS. 6A-6C are magnetic field graphs of respective radomes with massive MIMO antenna arrays 120 corresponding to the internal radomes 119, 119', 119" shown in corresponding FIGS. 5A-5C, as generated by a computational model. As shown in FIG. 6C, the radome 119 with the patterned shape of FIG. 5C has the lowest magnetic field and fewer "hot spots" relative to the curved radome (FIG. 6A/FIG. 5A) which has perimeter hot spots and the flat radome 119" (FIG. 6B) which as an interior row of hot spots.

Figure 7C:
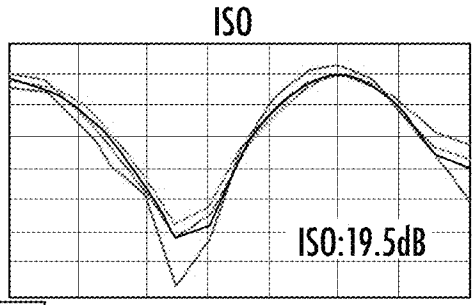
FIG. 7C is a graph of the isolation between adjacent columns (frequency (GHz) versus isolation decibel) for the massive MIMO antenna array and pattern shaped radome shown in FIG. 5C, as generated by a computational model.
Figure 7B:
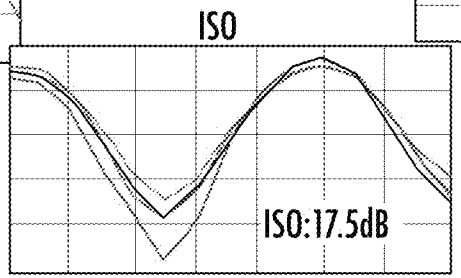
FIG. 7B is a graph of the isolation between adjacent columns (frequency (GHz) versus isolation decibel) for the massive MIMO antenna array and flat radome shown in FIG. 5B, as generated by a computational model.
Figure 7A:
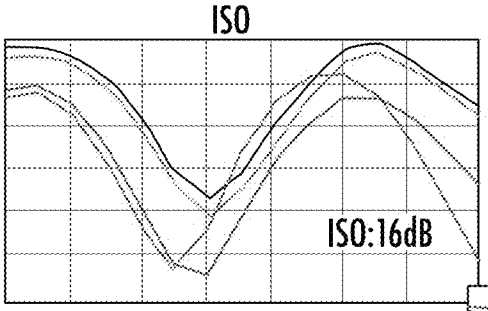
FIG. 7A is a graph of the isolation between adjacent columns (frequency (GHz) versus isolation decibel) for the massive MIMO antenna array and curved radome shown in FIG. 5A, as generated by a computational model.

FIG. 7A is a graph of the isolation between adjacent columns (frequency (GHz) versus isolation decibel) for the massive MIMO antenna array and curved radome 119' shown in FIG. 5A, as generated by a computational model. The four curves in FIG. 7A represent the isolation between two adjacent columns in each direction for each polarization. As shown, the isolation exceeds 16 dB across the entire 3.3-4.0 GHz operating frequency range. FIG. 7B is a similar graph of the isolation between adjacent columns (frequency (GHz) versus isolation decibel) for the massive MIMO antenna array and flat radome 119" shown in FIG. 5B, as generated by a computational model. As shown in FIG. 7B, the isolation exceeds 17.5 dB across the entire 3.3-4.0 GHz operating frequency range. The isolation is between the two polarizations in column, the BASTA name for this isolation is intra-band isolation. The four curves in the graphs/charts are the column 1 to column 4 intra-band isolation: the weaker coupling from the adjacent column, the higher polarization purity in column, and also the higher intra-band isolation.

FIG. 7C is a graph of the isolation between adjacent columns (frequency (GHz) versus isolation decibel) for the massive MIMO antenna array and pattern shaped radome 119 shown in FIG. 5C, illustrating an ISO: 19.5 dB, as generated by a computational model. This shape provides the highest isolation of about 17.5 dB.

Figure 8A:
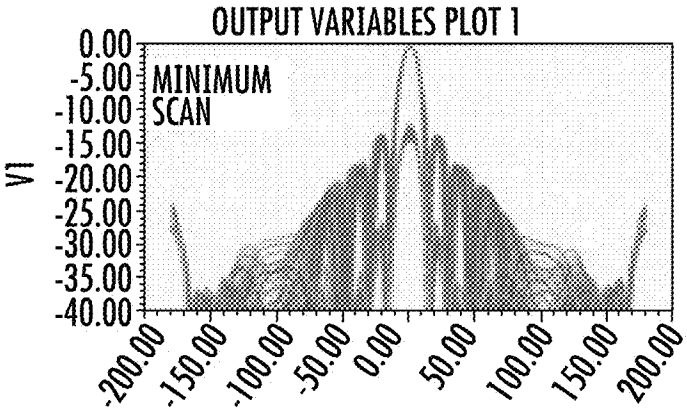
FIG. 8A is a graph of the azimuth pattern for an antenna beam that is not electronically scanned from boresight for the massive MIMO antenna array and flat radome shown in FIG. 5B, as generated by a computational model.
Figure 8B:
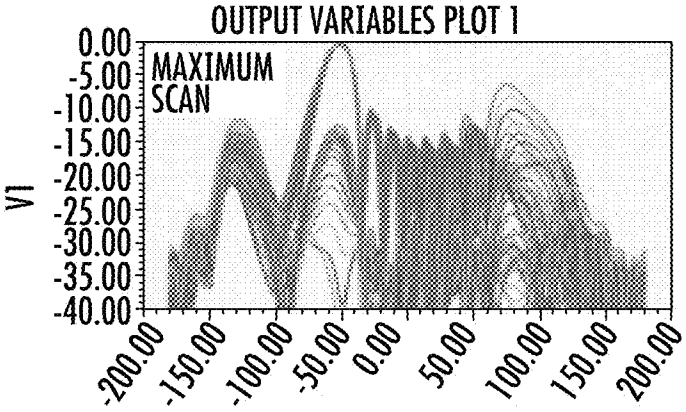
FIG. 8B is a graph of the azimuth pattern for an antenna beam that is electronically scanned from boresight to a maximum scan angle (here 53°) for the massive MIMO antenna array and flat radome shown in FIG. 5B, as generated by a computational model.

FIG. 8A is a graph of the azimuth pattern for an antenna beam that is not electronically scanned from boresight for the massive MIMO antenna array and flat radome 119" shown in FIG. 5B, as generated by a computational model. FIG. 8B is a graph of the azimuth pattern for an antenna beam that is electronically scanned from boresight to a maximum scan (here 53°) for the massive MIMO antenna array and radome 119" shown in FIG. 5B, as generated by a computational model.

Figure 9A:
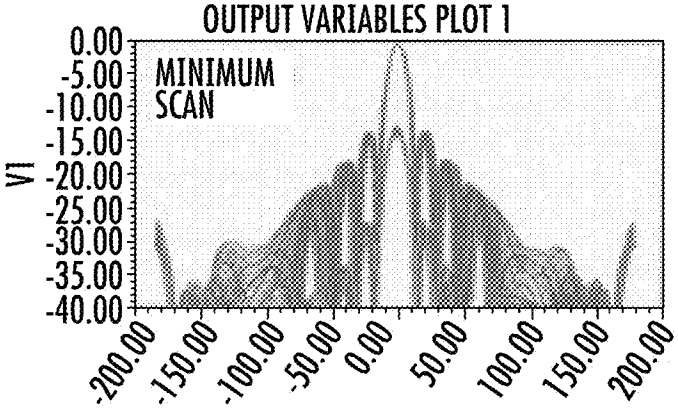
FIG. 9A is a graph of the azimuth pattern for an antenna beam that is not electronically scanned from boresight for the massive MIMO antenna array and pattern shaped radome shown in FIG. 5C, as generated by a computational model.
Figure 9B:
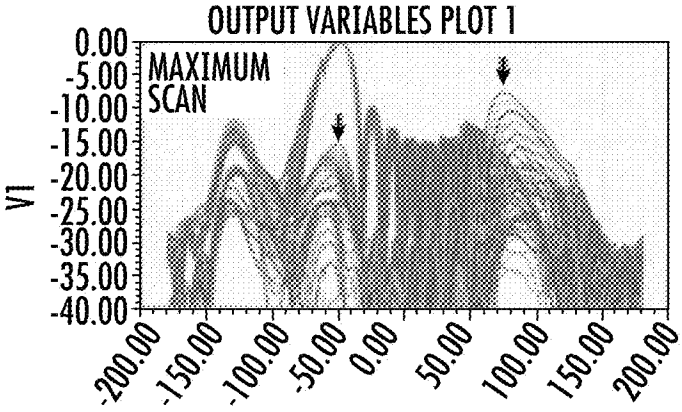
FIG. 9B is a graph of the azimuth pattern for an antenna beam that is electronically scanned from boresight to a maximum scan angle (here 53°) for the massive MIMO antenna array and pattern shaped radome shown in FIG. 5C, as generated by a computational model.

FIG. 9A is a graph of the azimuth pattern for an antenna beam that is not electronically scanned from boresight for the massive MIMO antenna array and pattern shaped radome 119 shown in FIG. 5C, as generated by a computational model. FIG. 9B is a graph of the azimuth pattern for an antenna beam that is electronically scanned from boresight to a maximum scan (53°) for the massive MIMO antenna array and the pattern shaped radome 119 shown in FIG. 5C, as generated by a computational model. The graphs of FIGS. 9A-9B illustrate the radiated RF energy as a function of azimuth angle from the boresight pointing direction for both the excited polarization and the non-excited polarization. As can be seen by comparing FIGS. 8B and 9B, the radome 119 exhibits better cross-polarization discrimination performance and has lower side lobe levels at the maximum scan angle as compared to the radome 119", as shown by the arrows in FIG. 9B.

Figure 10B:
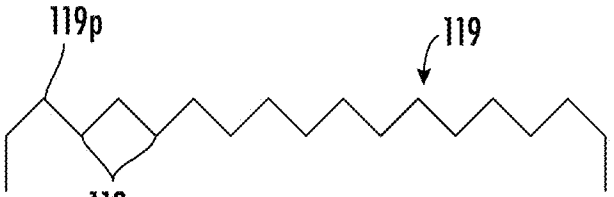
FIG. 10B is a section view of another embodiment of a pattern shaped radome according to embodiments of the present invention.
Figure 10A:
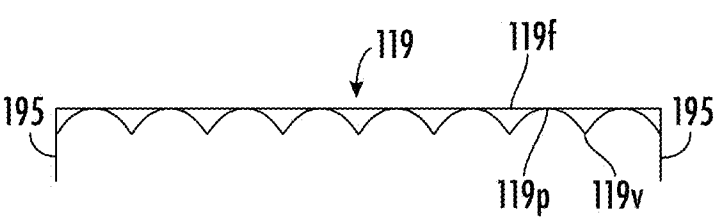
FIG. 10A is a section view of another embodiment of a pattern shaped radome according to embodiments of the present invention.

FIG. 10A is a section view of another embodiment of a pattern shaped radome 119 according to embodiments of the present invention. The radome 119 comprises a plurality of peaks 119*p* and valleys 119*v* as discussed above with respect to FIGS. 3, 4 and 5C. In the embodiment shown in FIGS. 3, 4 and 5C, the outer wall is shaped to define the peaks 119*p* and valleys 119*v*. In the embodiment shown in FIG. 10A, the outer surface can be flat 119*f* and the peaks 119*p* and valleys 119*v* can be formed in the interior part of the radome 119, similar to a scalloped configuration.

FIG. 10B is a section view of another embodiment of a pattern shaped radome 119 according to embodiments of the present invention. In this embodiment, the outwardly projecting peaks 119*p* are defined by pointed tips rather than curved (arcuate) segments shown in FIG. 5C.

Figure 10D:
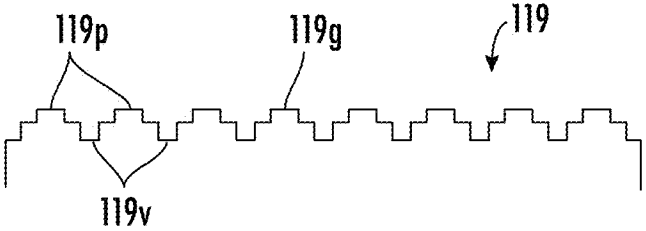
FIG. 10D is a section view of another embodiment of a pattern shaped radome according to embodiments of the present invention.
Figure 10C:
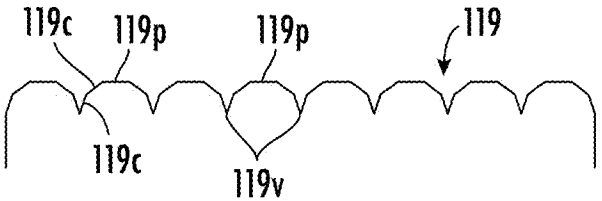
FIG. 10C is a section view of another embodiment of a pattern shaped radome according to embodiments of the present invention.

FIG. 10C is a section view of another embodiment of a pattern shaped radome 119 according to embodiments of the present invention. In this embodiment, the peaks 119*p* can have a frustoconical or flat segment 119*s* across a front (forwardmost) edge and have curvilinear or linear segments 119*c* connecting the valleys 119*v* to a corresponding peak 119*p*.

FIG. 10D is a section view of another embodiment of a pattern shaped radome 119 according to embodiments of the present invention. In this embodiment, the peaks 119*p* can be flat segments 119*g* with stepped-down segments connecting valleys 119*v*, and the valleys 119*v* can be flat valley segments rather than a pointed or curved valley.

Figure 10E:
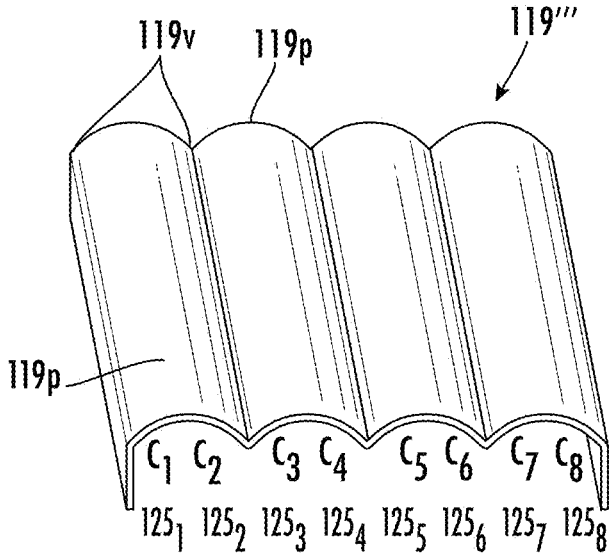
FIG. 10E is a front perspective view of another embodiment of a pattern shaped radome according to embodiments of the present invention.

FIG. 10E is a front perspective view of another embodiment of a pattern shaped radome 119''' according to embodiments of the present invention. In this embodiment, the radome 119" can have a peak segment 119*p* that resides between a pair of neighboring columns $\mathbf{125}_1$, $\mathbf{125}_2$ of radiating elements 121 with the valleys 119*v* separating the next laterally spaced apart neighboring shaped segment of the radome 119'''.

Figure 10F:
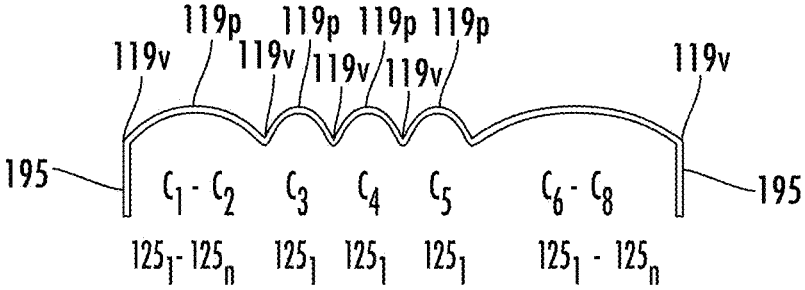
FIG. 10F is a section view of another embodiment of a pattern shaped radome according to embodiments of the present invention.

FIG. 10F is a section view of another embodiment of another pattern shaped radome 119'''' according to embodiments of the present invention. In this embodiment, the radome 119'''' can have a pattern with at least one peak segment 119*p* covering a plurality of adjacent columns $\mathbf{125}_1$-125*n*. As shown, one peak 119 spans across/covers two columns, $C_1$-$C_2$, of radiating elements and other peak segments 119*p* spans across/covers a single column $\mathbf{125}_1$, while yet another peak segment 119*p* spans across/covers three columns, C6-C8. The plurality of peak segments 119*p* covering a single column 125 can reside between the larger lateral span peak segments 119*p* (peak segments of larger width) that span across a plurality of columns $\mathbf{125}_1$-125*n*. In some embodiments, the number "n" can be a number between 2 and 16, for example. Any combination or single configuration of the above example configuration of peak segments 119*p* can be used according to some embodiments. In addition, the height of the peaks 119*p* for a respective radome 119 can be the same over respective lengths and a width of the inner radome 119 or can vary laterally and/or longitudinally. For example, the peaks 119*p* that are closer to the side walls 195 may have a greater height than the medial peaks or the reverse may be true. By way of another example, alternating rows of peaks 119*p* may vary in height. The depth of the valleys 119*v* can be the same or vary as well.

Figure 10G:
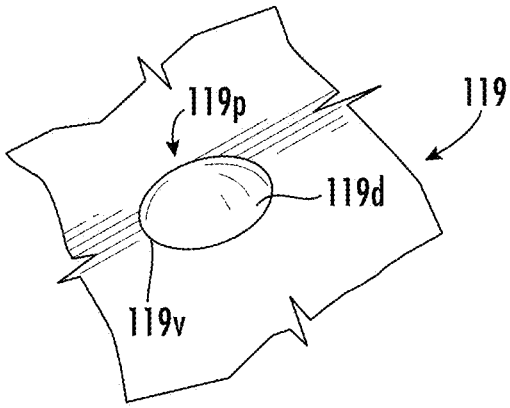
FIG. 10G is a schematic top perspective view of an example pocket shaped segment of a pattern shaped radome configured to cover a single radiating element of a multi-column antenna array according to embodiments of the present invention.

FIG. 10G is a schematic top perspective view of an example pocket shaped segment 119*d* of a pattern shaped radome 119. The pocket shaped segment can be configured as a dome 119*d* that can be configured to cover a plurality of or a single radiating element 121 in a column 125 of a multi-column antenna array 120 according to embodiments of the present invention. The pocket shaped segment 119*d* can have any sectional profile such as those described above and is not required to be an arcuate dome, e.g., the pocket shaped segment 119*d* can comprise a frustoconical shape. The dome 119*d* can be repeated across and along the radome 119 to be aligned with radiating elements 121 in the columns and across the rows of the array 120.

Figure 11:
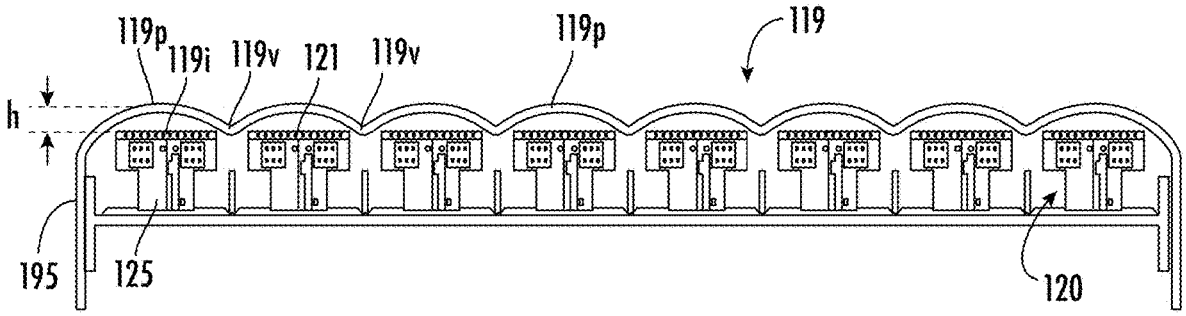
FIG. 11 is an enlarged section view of the pattern shaped radome shown in FIG. 5C illustrating an example spacing (H) between a radiating (antenna) element and a maximum outer projection (e.g., peak) of the pattern shaped radome according to embodiments of the present invention.

FIG. 11 is an enlarged section view of the shaped radome shown in FIG. 5C illustrating an example spacing (H) between a radiating (antenna) element 121 and a maximum outer projection (e.g., peak) 119*p* of the pattern shaped radome 119 according to embodiments of the present invention. This spacing H can vary. In some embodiments, the spacing H may be about one wavelength or less than one wavelength such as about ⅛λ, ¼λ, ½λ or ¾λ. Note that references herein to "wavelength" refer to the wavelength corresponding to the center frequency of the operating frequency band of the radiating element/array.

In some particular embodiments, for a 3.5 GHz radiating element 121, the H spacing can be about 9 mm. However, this distance H will vary with the operating frequency, different kinds/configurations of a radiating element 121 and different outer radomes 111 and positions thereof.

It is contemplated that the outer radome 111 and its spacing with respect to the inner radome 119 will affect the H spacing. Thus, the different height of the outer radome 111 can impact an optimum spacing H. For outer radomes 111 that are spaced apart greater than ½ wavelength from the inner radome 119, the H spacing may be larger relative to those embodiments that position the outer radome 111 closer than ½ wavelength to the inner radome 119.

The different shape of the radome 119 and/or the radome 111 can also affect the spacing H. For example, if the outer radome 111 has the very irregular curve, it may be difficult to find a good H spacing.

The dielectric constant (DK) of the outer radome 111 can also cause a different H spacing.

If the outer radome 111 is very far in front of the radiating element 121 (one wavelength or greater than one wavelength, for example), the spacing H (i.e., the distance between the radiating element 121 and the peak of the inner radome 119) may be positioned to be close to the arm (less than ½ wavelength) of the radiating element 121, because the outer radome 111 has a lower impact on the radiating element 121, so the H spacing is mostly related to the radiating element 121 itself.

In some embodiments, the distance between the outer radome 111 and a respective arm of a radiating element 121 can be larger than one-half wavelength and this spacing can have a lesser impact on the near field of the radiating element 121. If the outer radome 111 is positioned at greater than ½ wavelength from the arm of the radiating element 121 (e.g., greater than ½ wavelength and less than 3 wavelengths), the distance between the internal radome 119 to the radiating element 121 can be less than a half wavelength, such as % wavelength or ⅛ wavelength, in some embodiments.

The valleys 119*v* can reside at a common inward location across all rows or vary in an inwardly projecting depth. The peak segment 119*p* can extend a distance "h" outward from the valleys 119*v* in a range of about 5 mm-2 inches. The spacing between the peaks and valleys can depend on the element arm and the feeding point on the feed stalk. But normally, the distance of the peaks to the arm is over 5 mm, so the minimum spacing between the peaks and the valleys can also be over 5 mm.

The peaks 119*p* can reside over an open interior space 119*i* and this space can be an arcuate cavity (arcuate in the lateral dimension), in some embodiments.

Figure 12:
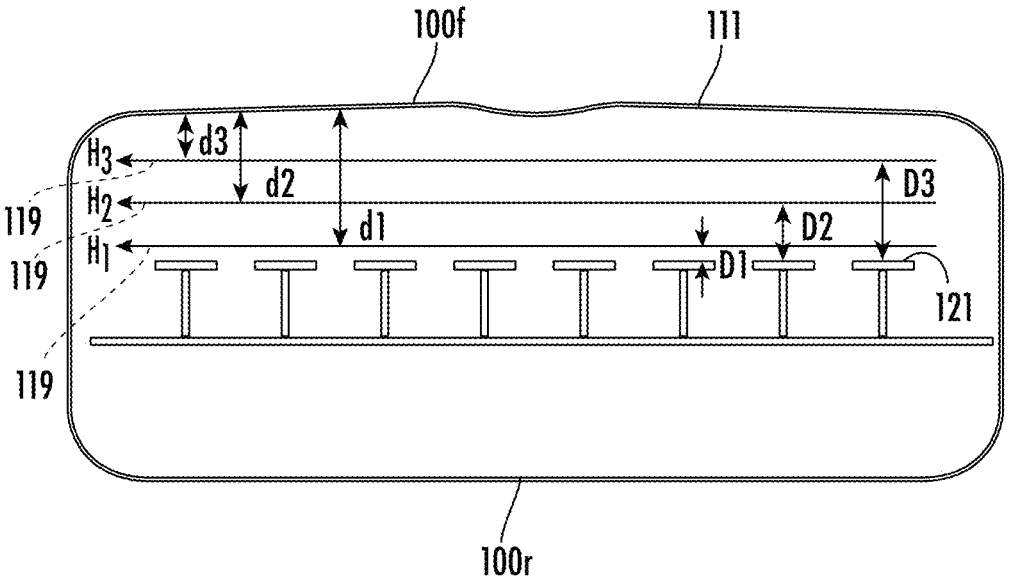
FIG. 12 is a section view that shows example positions, H1, H2, H3 for the internal radome relative to an outermost surface of radiating elements of the massive MIMO array and inside an outer radome according to embodiments of the present invention.

FIG. 12 shows example positions of the internal radome 119 that are labelled H1, H2, H3 that correspond to distances d1, d2, d3, respectively, for the internal radome 119 relative to the outer radome 111, and to distances D1, D2, D3 of the internal radome 119 from an outermost surface of the arm of the radiating element 121 according to embodiments of the present invention. When the internal radome 119 is closest to the radiating element D1 it is further away from the outer radome 111 as shown.

If the outer radome 111 is very close to the radiating element 121, such as, less than one half wavelength, it may be difficult to identify an optimum phase center above the radiating element 121. In this case, the internal radome 119 can be at H1 with a distance d1 to be as far away as possible from the outer radome 111, and the internal radome 119 can be at a distance D1 that is very close to the radiating element 121.

If the outer radome 111 is positioned at a range of one half of a wavelength to one wavelength from the radiating element 121, the outer radome 111 may not overly impact the radiating element 121, but still may cause a phase center to get higher, so the internal radome 119 can be positioned at H2 to be a little higher above the radiating element at D2 and with d2 being related to the dielectric constant DK and the shape of the outer radome 111.

If the distance between the outer radome 111 and the radiating element 121 is larger than a wavelength (e.g., position H3), the impact is much weaker. So the phase center is most related to the radiating element 121, normally the inner radome 119 should be close to the element radiating arm.

Figure 13:
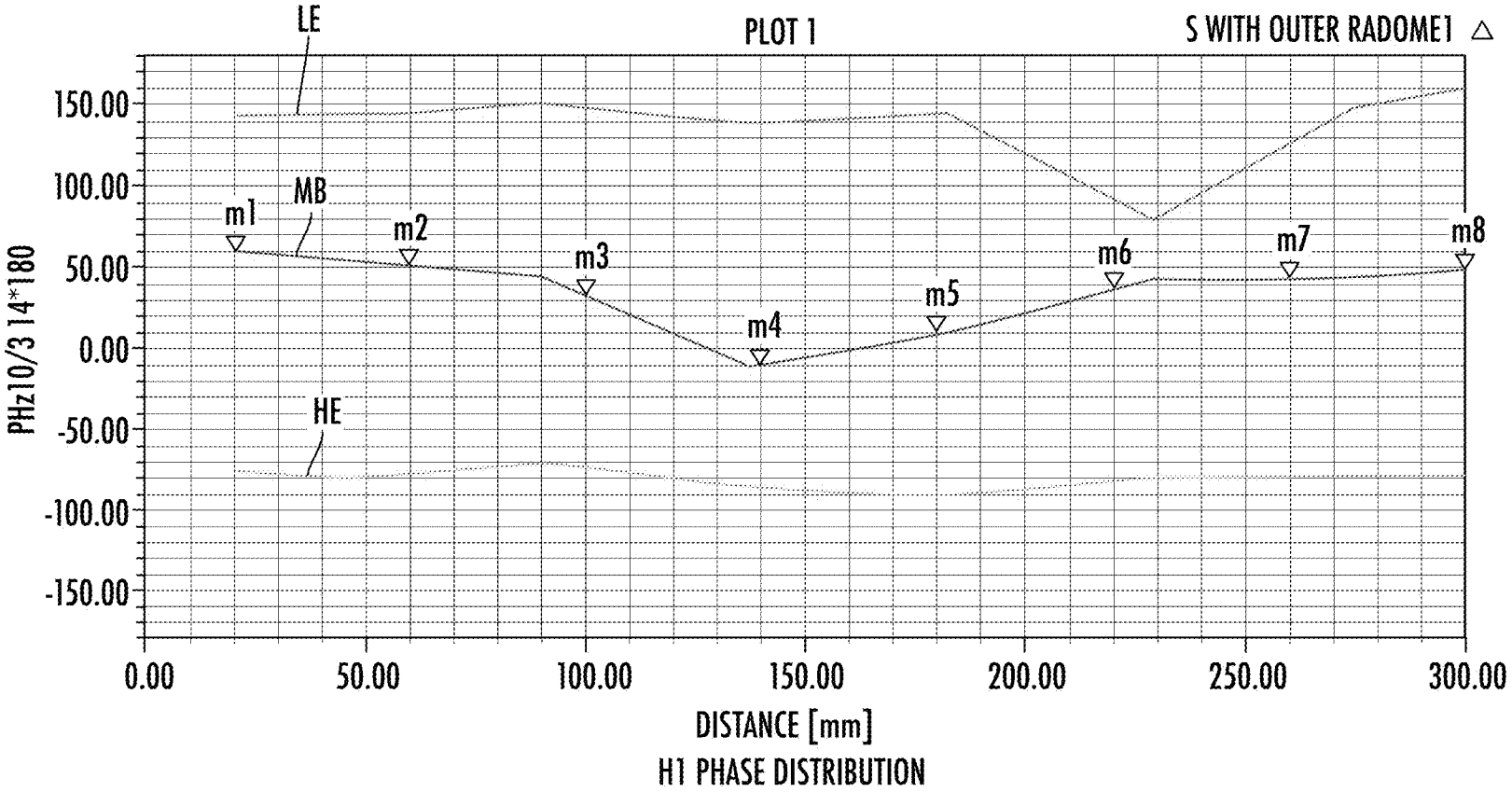
FIG. 13 is a graph of phase distribution using the position H1 of FIG. 12, generated by a computational model.
Figure 14:
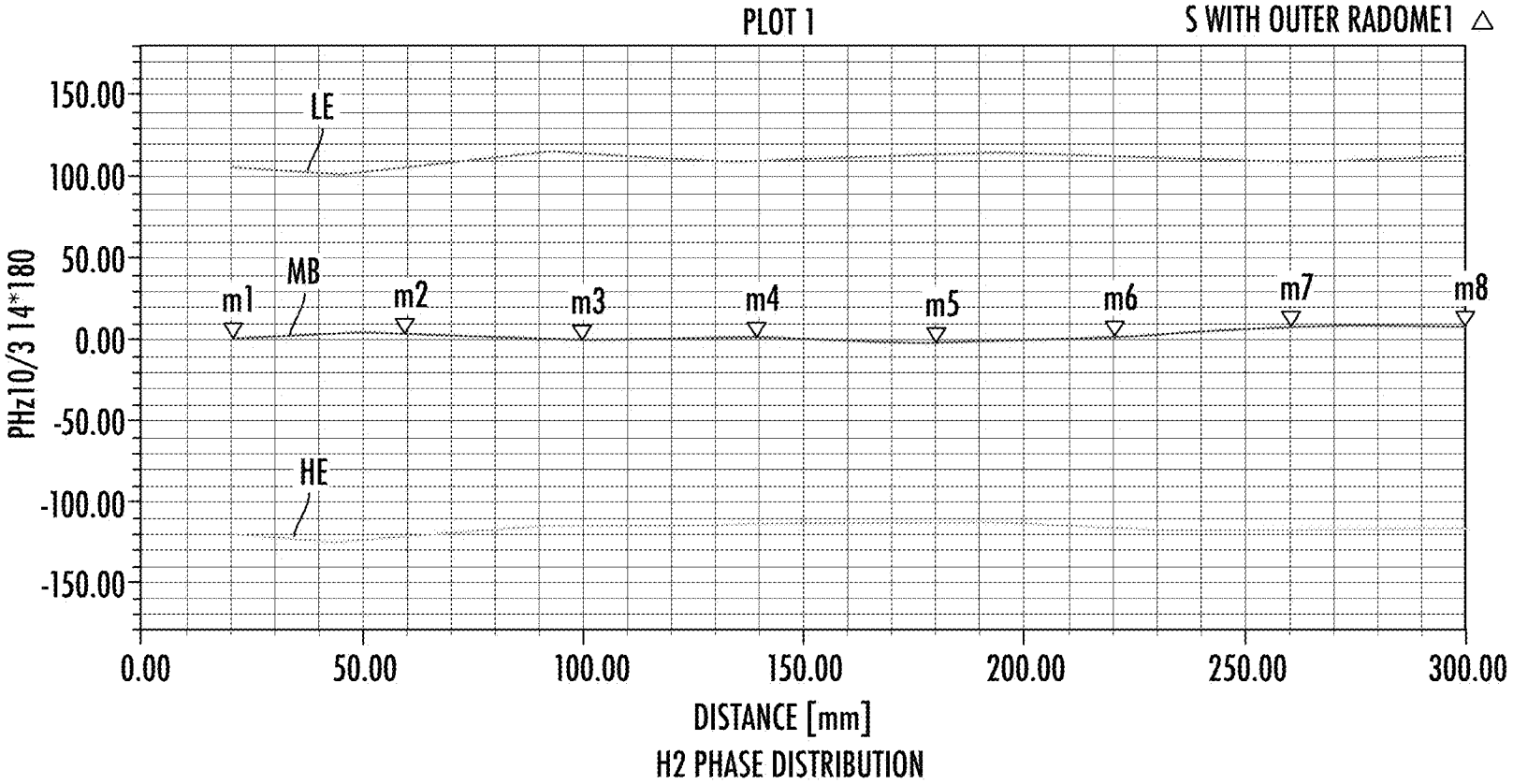
FIG. 14 is a graph of phase distribution using the position H2 of FIG. 12, generated by a computational model.
Figure 15:
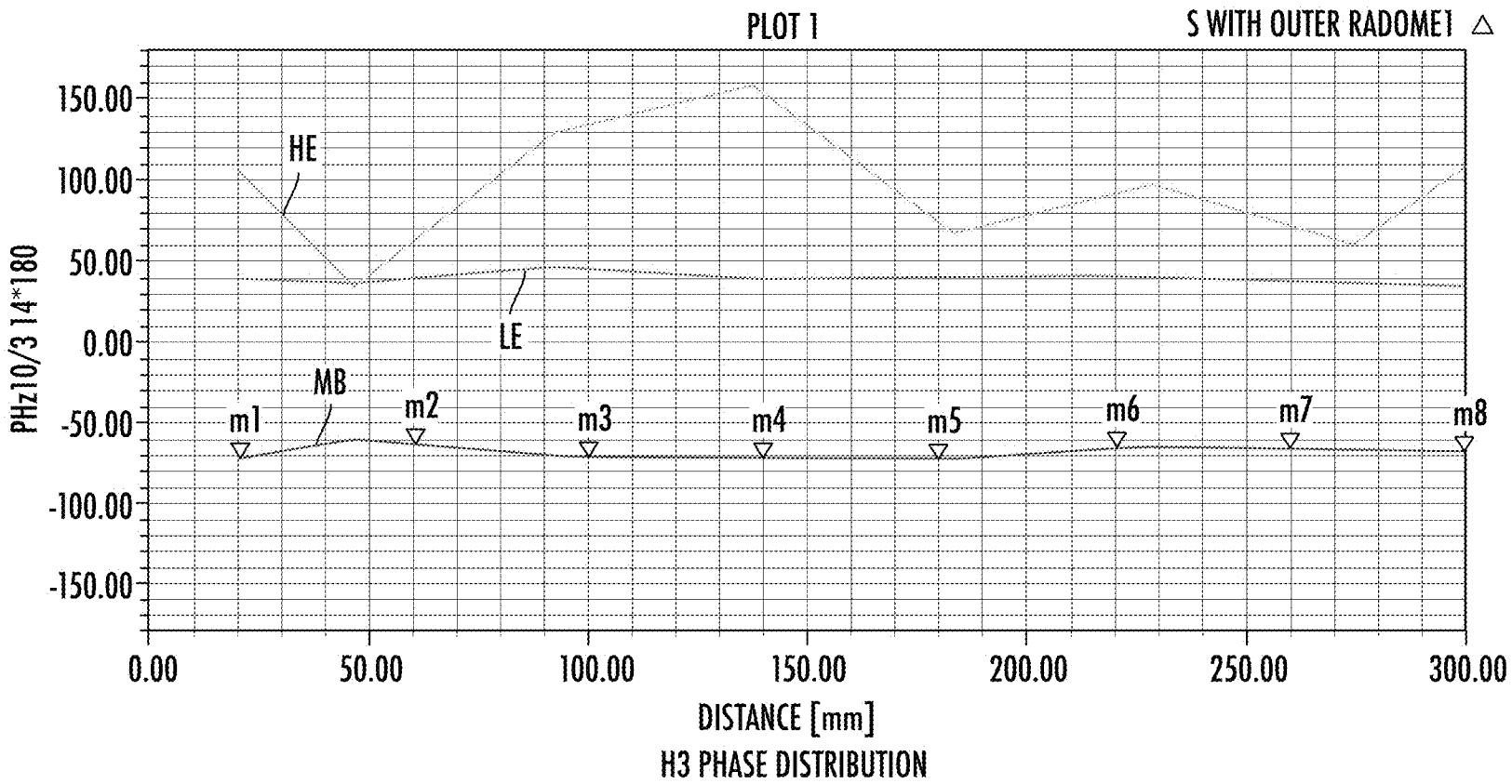
FIG. 15 is a graph of phase distribution using the position H3 of FIG. 12, generated by a computational model.

FIGS. 13-15 are graphs of the distribution of the phase centers of the radiating elements in a row of the massive MIMO array 120 when the internal radome 119 is at the positions H1, H2, H3, respectively of FIG. 12. The phase distribution data in FIGS. 13-15 was generated by a computational model. The three separate curves in each graph represent three different frequencies, namely the blue curve (LE) is the lowest frequency in the operating frequency band; the red curve (MB) is the center frequency of the operating frequency band; and the green curve (HE) is the highest frequency in the operating frequency band. The marks $m_1$-$m_8$ show the simulated phase value of the radiating element for each radiating element 121 in the row of the array 120 from left to right across the array 120. As can be seen by comparing the three graphs, the most stable or best phase center distribution is provided when the inner radome is at position H2. The H2 position is the best height for the radome 119, as the phase center is stable across the entire array for the full operating frequency band (flat graph of phase across distance).

Figure 16:
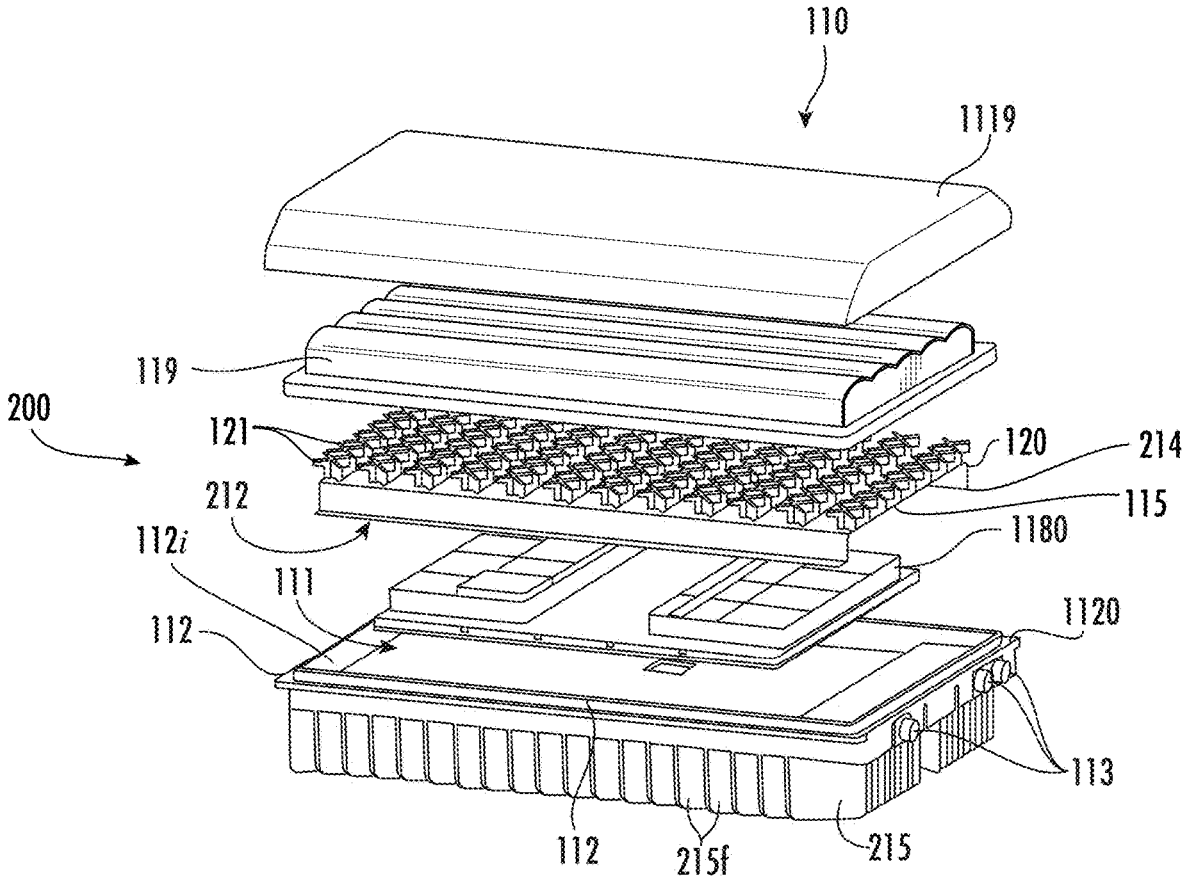
FIG. 16 is a partially exploded side perspective view of an example active antenna module comprising the shaped internal radome according to embodiments of the present invention.

FIG. 16 is a partially exploded side perspective view of an example active antenna module 110 comprising the pattern shaped internal radome 119 according to embodiments of the present invention. The term "active antenna module"

refers to an integrated cellular communications unit comprising a remote radio unit (RRU) and associated antenna elements that is capable of electronically adjusting the amplitude and/or phase of the subcomponents of an RF signal that are output to different antenna elements or groups thereof. The active antenna module 110 comprises the RRU and antenna but may include other components such as a filter, a, calibration network, a controller and the like. The active antenna module 110 can have an outer perimeter 112 with an inner facing seal interface 112*i*. The active antenna module 110 can also include connectors 113.

As shown in FIG. 16, the active antenna module 110 can comprise an RRU (remote radio unit) unit 1120 with heat sink 215 and fins 215*f*, an integrated filter and calibration printed circuit board assembly 1180, and massive MIMO array 120. The RRU unit 1120 is a radio unit that typically includes radio circuitry that converts base station digital transmission to analog RF signals and vice versa. The RRU unit 1120 can couple to the integrated filter and calibration board assembly 1180 via connectors.

The antenna module 110 may optionally further include an outer radome 1111. The outer radome 1111 covers the first (inner) radome 119.

FIGS. 17A and 17B are back perspective views of an example base station antenna 100 comprising the pattern shaped internal radome 119 according to embodiments of the present invention.

The active antenna module 110 can be sealably coupled to the housing 100*h* and, when installed, can form part of the rear 100*r* of the antenna 100. The active antenna module 110 can have an inner facing surface that has a seal interface 112*i* that is be sealably and releasably coupled to the rear 100*r* of the housing 100*h* to provide a water-resistant or water-tight coupling therebetween. The active antenna module 110 can be mounted to a recessed segment 108 of the antenna housing 100*h* surrounding a cavity 155 configured to receive and position the active antenna module 110 so that a rear face 110*r* is externally accessible and exposed to environmental conditions. The antenna housing 100*h* can include a passive antenna assembly comprising radiating elements.

The base station antenna 100 can also include planar seal interface 160 and a seal cap 165 positioned at the rear of the housing 100*h* between the upper segment with the active antenna module 110 and a lower segment. The sidewalls of the housing 100*h* can project rearward a greater distance D2 at the lower segment than at the upper portion, having a shorter outward extent of distance (D1) for a length corresponding to the active antenna module 110. For further discussion of example active antenna modules 110 for base station antennas 100, see, co-pending, co-assigned U.S. Provisional Application Ser. No. 63/075,344, filed Sep. 8, 2020, the contents of which are hereby incorporated by reference as if recited in full herein.

Referring to FIGS. 16, 17A and 17B, the base station antenna 100 can include an antenna assembly 200 that includes the radiating elements 121 and a backplane 210 that has sidewalls 212 and a planar front surface 214 that acts as a reflector 115 to reflect rearwardly emitted RF radiation in the forward direction. Herein, the front surface of backplane 210 is referred to as the first reflector 115. Various mechanical and electronic components of the antenna (not shown) may be mounted in the chamber defined between the sidewalls 212 and the back side of the reflector surface such as, for example, phase shifters, remote electronic tilt units, mechanical linkages, a controller, diplexers, and the like. The first reflector 115 may comprise or include a metallic surface that serves as a reflector and ground plane for the radiating elements 121 of the antenna 100.

The radiating elements 121 can be provided as a plurality of dual-polarized radiating elements that are mounted to extend forwardly from the first reflector 115. The radiating elements 121 can include low-band radiating elements, mid-band radiating elements and high-band radiating elements. The low-band radiating elements can be mounted in two columns to form two linear arrays of low-band radiating elements. The low-band radiating elements may be configured to transmit and receive signals in a first frequency band such as, for example, the 694-960 MHz frequency range or a portion thereof. The mid-band radiating elements may likewise be mounted in two columns to form two linear arrays of mid-band radiating elements. The mid-band radiating elements may be configured to transmit and receive signals in a second frequency band such as, for example, the 1427-2690 MHz frequency range or a portion thereof. The high-band radiating elements can be mounted in four columns to form four linear arrays f high-band radiating elements. The high-band radiating elements may be configured to transmit and receive signals in a third frequency band such as, for example, the 3300-4200 MHz frequency range or a portion thereof.

The low-band, mid-band and high-band radiating elements 121 may each be mounted to extend forwardly from the first reflector 115. The first reflector 115 may comprise a sheet of metal that, as noted above, serves as a reflector and as a ground plane for the radiating elements 121. Each radiating element 121 can be implemented as a cross-polarized dipole radiating element having feed stalks 121*s* that can be formed using a pair of printed circuit boards that are configured in an "X" shape and a pair of dipole radiator arms 121*a* that are mounted forwardly from the backplane by the feed stalks 121*s*.

Since the high-band radiating elements operate in a much higher frequency band, the feed stalks 121*s* on the high-band radiating elements may be much shorter than the feed stalks 121*s* on the low-band radiating elements, and hence the dipole radiators on the high-band radiating elements may be positioned relatively further back from a front surface 100*f* of the housing and/or the outer radome 111.

As discussed above, a radome 111 may start to reflect RF signals emitted by a radiating element that is mounted behind the radome as the ratio of the thickness of the radome to the wavelength of the RF signal increases. Various other factors, including the dielectric constant of the radome material and the distance separating the radiating element from the radome also impact the degree of reflection.

Figure 18:
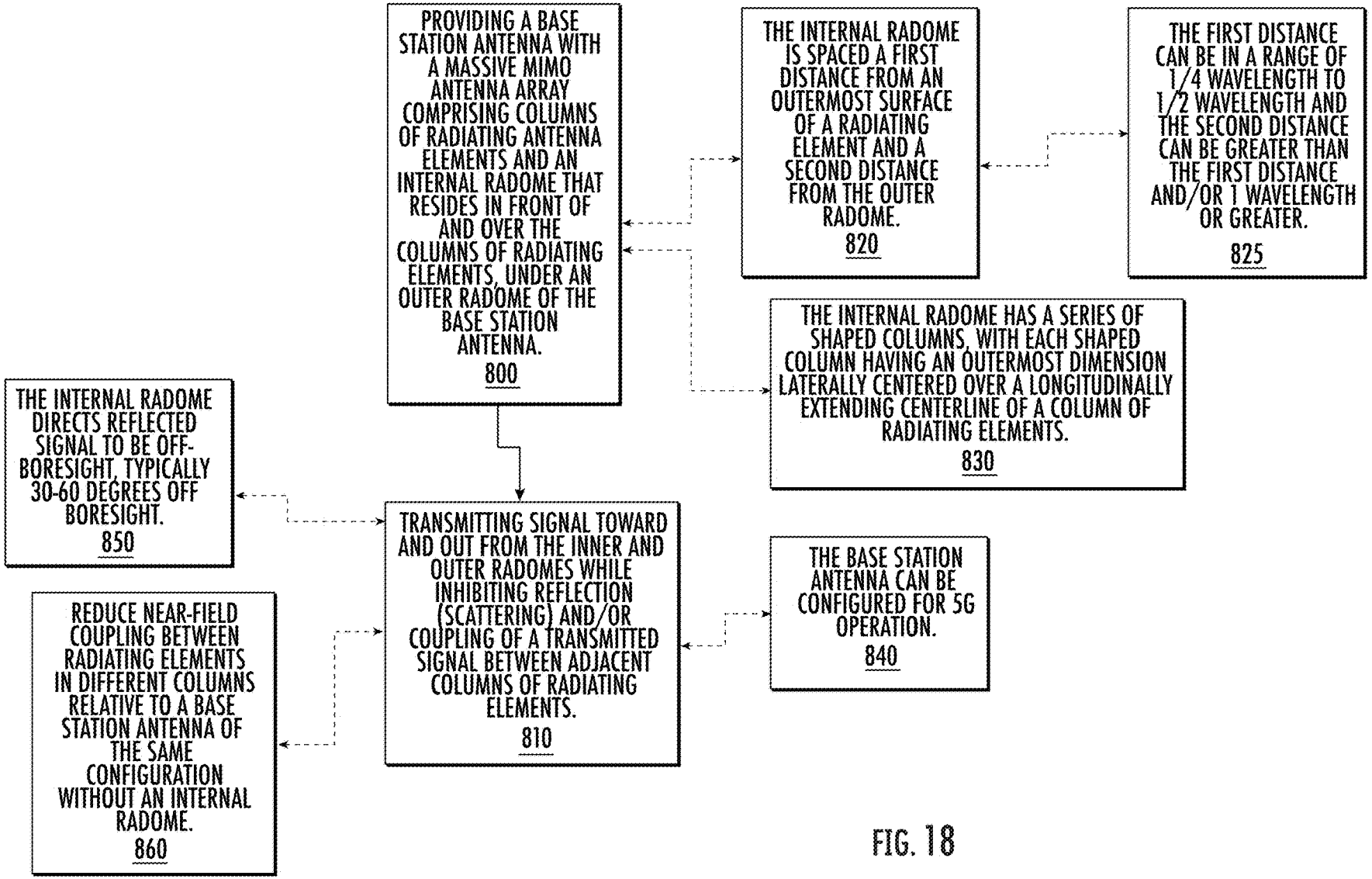
FIG. 18 is a flow chart of example actions that can be carried out to reduce (near-field) cross-column coupling and/or reflection (scattering) according to embodiments of the present invention.

FIG. 18 is a flow chart of example actions that can be carried out to reduce (near-field) cross-column coupling and/or reflection (scattering) according to embodiments of the present invention. A base station antenna with a massive MIMO antenna array comprising columns of radiating antenna elements and an internal radome resides over the columns of radiating elements and under an outer radome of the base station antenna is provided (block 800).

An RF signal is transmitted toward and out of the internal and outer radomes while inhibiting reflection (scattering) and/or coupling of a transmitted signal between adjacent columns of radiating elements (block 810).

The internal radome is spaced a first distance from an outermost surface of a radiating element and a second distance from the outer radome (block 820).

The first distance can be in a range of ¼ wavelength to ½ wavelength and the second distance can be greater than the first distance and/or in a range of about ½ wavelength or greater such as about one wavelength or greater (block 825).

The internal radome has a series of shaped columns, with each shaped column having an outermost (peak segment) dimension laterally centered over a center of a radiating element and/or a longitudinally extending centerline of a column of radiating elements (block 830).

The base station antenna can be configured for 5G operation (block 840).

The internal radome directs reflected signal to be off-boresight (block 850). The signal can be directed to be at 30-60 degrees off centerline of the boresight.

Reducing near-field coupling between radiating elements in different columns relative to a base station antenna of the same configuration without an internal radome (block 860).

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

an outer radome defining a front of the base station antenna;

an internal radome; and a multi-column antenna array positioned behind the internal radome.

2. The base station antenna of claim 1, wherein the internal radome is configured with a plurality of peak segments that are laterally spaced apart, and wherein the peak segments project outwardly toward the front of the base station antenna behind the outer radome.

3. The base station antenna of claim 1, wherein a respective peak segment of the plurality of peak segments resides in front of and longitudinally and laterally aligned with at least one radiating element of a corresponding column of radiating elements of the multi-column antenna array.

4. The base station antenna of claim 2, wherein each peak segment is separated by a pair of valley segments, one valley segment on a right side and one valley segment on a left side of the peak segment.

5. The base station antenna of claim 2, wherein a respective peak segment of the plurality of peak segments defines a cavity that is positioned over a respective radiating element of the multi-column antenna array.

6. The base station antenna of claim 5, wherein the cavity has an arcuate shape with the arc curving over the respective radiating element to provide a maximal front facing portion laterally centered over a center of the respective radiating element.

7. The base station antenna of claim 6, wherein the respective peak segment merges into right and left side valley segments that project inwardly toward ends of radiating arms of neighboring radiating elements.

8. The base station antenna of claim 1, wherein each peak segment is provided as a longitudinally extending peak segment that is positioned over a respective column of the multi-column antenna array to thereby reduce coupling between columns of radiating elements and/or provide a common near field environment for each radiating element and/or each column of radiating elements.

9. The base station antenna of claim 1, wherein the multi-column antenna array comprises radiating elements held by respective stalks, wherein radiating arms of the radiating elements are positioned at a first distance d1 from the outer radome and a second distance d2 from the internal radome, wherein the outer radome is positioned a third distance d3 from the internal radome, and wherein d2 is less than d1 and d3.

10. The base station antenna of claim 1, wherein the multi-column antenna array comprises radiating elements with radiating arms, wherein the radiating arms are positioned at a ½ wavelength or less from the inner radome, where the wavelength refers to the wavelength corresponding to the center frequency of the operating frequency band of the multi-column array, and wherein the radiating arms are positioned at 1 wavelength or more from the outer radome.

11. The base station antenna of claim 1, wherein the internal radome is configured to direct reflected signal back to an originating radiating element and/or column of radiating elements of the multi-column array to thereby reduce scattering and improve antenna performance.

12. The base station antenna of claim 1, wherein the internal radome has opposing right and left sides that extend inwardly and couple to a reflector.

13. The base station antenna of claim 1, wherein the internal radome is configured to generate a near-field environment that is substantially the same for each radiating element and/or columns of radiating elements of the multi-column array.

14. The base station antenna of claim 1, wherein the internal radome is configured to cooperate with radiating elements of the multi-column array to provide an isolation of at least 19 dB between radiating elements in adjacent columns.

15. A base station antenna, comprising:

a reflector;

a multi-column antenna array that extends forwardly from the reflector; and a radome that is positioned in front of the multi-column array, wherein the radome includes a plurality of laterally spaced-apart peak segments that project outwardly away from the multi-column array.

16. The base station antenna of claim 15, wherein a respective peak segment of the plurality of peak segments resides in front of and longitudinally and laterally aligned with at least one radiating element of a corresponding column of radiating elements of the multi-column antenna array.

17. The base station antenna of claim 15, wherein each peak segment is separated by a pair of valley segments, one valley segment on a right side and one valley segment on a left side of the peak segment.

18. The base station antenna of claim 15, wherein each peak segment is provided as a longitudinally extending peak segment that is positioned over a respective column of the multi-column antenna array to thereby reduce coupling between columns of radiating elements and/or provide a common near field environment for each radiating element and/or each column of radiating elements.

19. The base station antenna of claim 15, wherein the radome is an inner radome, wherein the multi-column antenna array comprises radiating elements held by respective stalks, wherein radiating arms of the radiating elements are positioned at a first distance d1 from an outer radome and a second distance d2 from the internal radome, wherein the outer radome is positioned a third distance d3 from the internal radome, and wherein d2 is less than d1 and d3.

20. The base station antenna of claim 15, wherein the radome is configured to direct reflected signal back to an originating radiating element and/or column of radiating elements of the multi-column array to thereby reduce scattering and improve antenna performance.

21. A base station antenna, comprising:

a reflector;

a multi-column antenna array that extends forwardly from the reflector; and a radome that is positioned in front of the multi-column array, wherein the radome includes a plurality of longitudinally extending segments that are aligned in front of respective columns of the multi-column array, where each longitudinally-extending segment has a transverse cross-section that includes sub-segments that are at different front-to-back distances from the reflector.

22. The base station antenna of claim 21, wherein the sub-segments comprise a peak segment that resides in front of and longitudinally and laterally aligned with a respective column of the multi-column antenna array.

23. The base station antenna of claim 21, wherein the radome is an internal radome, wherein the base station antenna further comprises an external radome that resides in front of the internal radome, wherein the multi-column antenna array comprises radiating elements held by respective stalks, wherein radiating arms of the radiating elements are positioned at a first distance d1 from the outer radome and a second distance d2 from the internal radome, wherein the outer radome is positioned a third distance d3 from the internal radome, and wherein d2 is less than d1 and d3.

24. The base station antenna of claim 21, wherein the radome is an internal radome, wherein the base station antenna further comprises an external radome that resides in front of the internal radome, wherein the multi-column antenna array comprises radiating elements with radiating arms, wherein the radiating arms are positioned at a ½ wavelength or less from the inner radome, where the wavelength refers to the wavelength corresponding to the center frequency of the operating frequency band of the multi-column array, and wherein the radiating arms are positioned at 1 wavelength or more from the outer radome.

* * * * *